US011795045B2

(12) United States Patent
Krulitsch et al.

(10) Patent No.: US 11,795,045 B2
(45) Date of Patent: Oct. 24, 2023

(54) METHOD OF FILLING AND CLOSING CONTAINERS, SUCH AS BOTTLES AND SIMILAR CONTAINERS, FOR CONTAINING PRODUCTS, SUCH AS BEVERAGES AND SIMILAR PRODUCTS

(71) Applicant: KHS GMBH, Dortmund (DE)

(72) Inventors: Dieter-Rudolf Krulitsch, Bad Kreuznach (DE); Bernd Bruch, Weinsheim (DE); Ludwig Clüsserath, Bad Kreuznach (DE); Jonathan Lorenz, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 17/683,773

(22) Filed: Mar. 1, 2022

(65) Prior Publication Data

US 2022/0289546 A1 Sep. 15, 2022

Related U.S. Application Data

(63) Continuation-in-part of application No. PCT/EP2020/073690, filed on Aug. 25, 2020.

(30) Foreign Application Priority Data

Sep. 2, 2019 (DE) ..... 102019123460.3

(51) Int. Cl.
*B67C 3/12* (2006.01)
*B67C 3/10* (2006.01)
(Continued)

(52) U.S. Cl.
CPC ..... *B67C 3/12* (2013.01); *B67C 3/06* (2013.01); *B67C 3/10* (2013.01); *B67C 3/2614* (2013.01); *B67C 3/2634* (2013.01); *B67C 3/2642* (2013.01); *B67C 3/283* (2013.01); *B67C 7/00* (2013.01); *B67C 7/0073* (2013.01); *B67C 2003/228* (2013.01); *B67C 2003/2697* (2013.01)

(58) Field of Classification Search
CPC .... B67C 3/12; B67C 3/06; B67C 3/10; B67C 3/2614; B67C 3/2634; B67C 3/2642; B67C 3/283; B67C 2003/228; B67C 2003/2697; B67C 7/00; B67C 7/0073
See application file for complete search history.

(56) References Cited

U.S. PATENT DOCUMENTS 4,989,650 A * 2/1991 Weiss ..... B67C 3/06 141/50
5,082,033 A * 1/1992 Weiss ..... B67C 3/06 141/50
(Continued)

FOREIGN PATENT DOCUMENTS

DE 10008426 7/2011
DE 102014104873 10/2015
(Continued)

*Primary Examiner* — Nicolas A Arnett
(74) *Attorney, Agent, or Firm* — Laurence A. Greenberg; Werner H. Stemer; Ralph E. Locher

(57) ABSTRACT

In a method of filling and closing containers, such as bottles and similar containers, for containing liquid products, such as beverages and similar products, the filling and closing can be performed in a filling and closing machine or arrangement.

20 Claims, 11 Drawing Sheets

(51) Int. Cl.

| | |
|---|---|
| ***B67C 3/26*** | (2006.01) |
| ***B67C 3/28*** | (2006.01) |
| ***B67C 7/00*** | (2006.01) |
| ***B67C 3/06*** | (2006.01) |
| *B67C 3/22* | (2006.01) |

(56) References Cited

U.S. PATENT DOCUMENTS

| | | | | |
|---|---|---|---|---|
| 6,192,946 | B1 * | 2/2001 | Clusserath | B67C 3/286 141/49 |
| 6,463,964 | B2 * | 10/2002 | Clusserath | B67C 3/065 141/63 |
| 9,108,836 | B2 * | 8/2015 | Clusserath | B67C 3/2622 |
| 9,150,398 | B2 * | 10/2015 | Hartel | B67C 3/20 |
| 9,193,574 | B2 * | 11/2015 | Krulitsch | B67C 3/28 |
| 9,205,937 | B2 * | 12/2015 | Krulitsch | B67C 3/026 |
| 9,637,254 | B2 * | 5/2017 | Fahldieck | B67C 3/26 |
| 9,790,072 | B2 * | 10/2017 | Clusserath | B67C 3/2637 |
| 9,809,436 | B2 * | 11/2017 | Clüsserath | B67C 3/10 |
| 10,040,582 | B2 * | 8/2018 | Gai | B67C 3/262 |
| 10,040,678 | B2 * | 8/2018 | Gai | B67C 3/2617 |
| 10,294,091 | B2 * | 5/2019 | Eaton | B67C 3/28 |
| 10,494,125 | B2 * | 12/2019 | Andersson | B65B 31/045 |
| 10,710,862 | B2 * | 7/2020 | Clüsserath | B65B 57/145 |
| 10,836,621 | B2 * | 11/2020 | Meinzinger | B67C 3/2634 |
| 11,247,888 | B2 * | 2/2022 | Knott | B67C 3/06 |
| 11,535,503 | B2 * | 12/2022 | Kursawe | B65B 3/26 |
| 2001/0045242 | A1 * | 11/2001 | Clusserath | B67C 3/007 141/144 |
| 2015/0284233 | A1 * | 10/2015 | Meinzinger | B67C 3/26 141/39 |
| 2015/0284234 | A1 * | 10/2015 | Meinzinger | B67C 3/10 141/59 |
| 2019/0071295 | A1 * | 3/2019 | Clüsserath | B67C 7/004 |
| 2019/0106311 | A1 * | 4/2019 | Habersetzer | B67C 7/00 |
| 2021/0188610 | A1 * | 6/2021 | Poeschl | B67C 7/004 |
| 2021/0387840 | A1 * | 12/2021 | Clüsserath | B67C 3/10 |
| 2022/0219962 | A1 * | 7/2022 | Clüsserath | A23L 2/54 |

FOREIGN PATENT DOCUMENTS

| | | |
|---|---|---|
| DE | 102016108502 | 11/2017 |
| EP | 1127835 | 8/2001 |
| EP | 2927189 | 10/2015 |
| EP | 3473588 | 4/2019 |

* cited by examiner

METHOD OF FILLING AND CLOSING CONTAINERS, SUCH AS BOTTLES AND SIMILAR CONTAINERS, FOR CONTAINING PRODUCTS, SUCH AS BEVERAGES AND SIMILAR PRODUCTS

CROSS-REFERENCE TO RELATED APPLICATIONS

The present application is a Continuation-in-Part of International Patent Application No. PCT/EP2020/073690, filed Aug. 25, 2020, which claims the benefit of Federal Republic of Germany Patent Application No. DE102019123460.3, filed Sep. 2, 2019, each of which is incorporated by reference herein in its entirety.

BACKGROUND INFORMATION

1. Technical Field

The application relates to a method of filling and closing containers, such as bottles and similar containers, for containing liquid products, such as beverages and similar products. The application further relates to a method of filling containers with a liquid filling material and for closing the containers with a closing cover, such as a crown cork bottle cap or similar cap. The application relates to a method for a container handling arrangement, such as can be used in container handling machines in the beverage industry, such as container handling machines with capacities of more than 10,000 containers per hour or container handling machines with a capacity of more than 50,000 containers per hour. The application further relates to a method for a container handling arrangement, which comprises what is referred to as a filling machine or filler for filling containers with liquid filling material. The application also relates to a container handling arrangement, which at the same time includes the function of a closer for closing filled containers, and in this situation is configured such as for closing filled containers with closure covers, such as crown corks.

2. Background Art

This section is for informational purposes only and does not necessarily admit that any publications discussed or referred to herein, if any, are prior art.

Filling machines of the type referred to above comprise a plurality of handling stations or handling positions, which can also be understood to be filling stations or filling positions. Provided at each filling station of the filling machine is a filling element or filling apparatus, with a filling valve or liquid valve, by way of the dispensing opening of which the liquid filling material is dispensed into the container. For example, the dispensing of the filling material into the containers takes place by means of what is referred to as "free jet filling."

"Free jet filling" or "free jet complete filling" is understood within the framework of the present application to be a filling method in which the liquid filling material flows to the container which is to be filled from the liquid valve in a free filling jet or filling material jet, wherein the flow of the filling material is not influenced or changed by guide elements, such as deflection screens, swirl bodies, or short or long filling pipes. Free jet filling can take place both pressureless as well as under pressure. With pressureless free jet filling, the container exhibits ambient pressure, wherein, as a rule, the container is not in contact with its container mouth or opening at the filling element, but is located at a distance from the filling element or from a dispensing opening provided. However, if, with pressureless filling, the container is in contact with its container mouth at the filling element, a gas path creates a connection between the interior of the container and the surrounding environment, as a result of which pressureless filling becomes possible. For example, the gas contained in the container and the gas displaced by the container by the liquid flowing into the container can also escape into the surrounding environment by way of this gas path.

If the free jet filling takes place under a pressure which deviates from ambient pressure, the container is then pressed with its mouth against the filling element and sealed, and the pressure in the interior of the container is adjusted, by the imposing of a prestressing gas or the imposing of a negative pressure, to this pressure which deviates from the ambient pressure, which can be both above as well as below the ambient pressure.

Closers of the type referred to heretofore are, as a rule, likewise provided with a plurality of handling stations or handling positions, which can also be understood as closing stations or closing positions. At each closing station of the closer a closing apparatus or closing tool is provided, with a closing punch, which can be used to press a crown cork onto the container mouth, which crown cork is then finally secured with sealing effect by deformation.

In one example of a container handling arrangement for a beverage filling process, a beverage containing carbon dioxide is filled into an evacuated container, such as a bottle. With this filling, the filling process into the evacuated bottle takes place extremely quickly at a very high speed, as a result of which it is not possible for the container to be released and drawn away from the filling point rapidly, since this would inevitably lead to an excessive foaming of the filling material. With this method, the filling process is therefore combined with a closing process directly at the filling location. In this situation, the closing process takes place in a closed gas chamber above the bottle and under a pressure which is above the carbon dioxide saturation pressure. In this situation, the container to be filled is first flushed with a flushing gas containing steam before the actual evacuation.

In this situation, it is important to limit the handling times during which the containers, often glass bottles, come in contact with the hot flushing gas containing steam, since otherwise a disproportionately high amount of glass breakage will be incurred by the temperature shock. In other words, since the flushing gas or steam is extremely hot or high temperature and must be introduced quickly to maintain high container processing times, the container, which is often or usually made from glass or a similar material, experiences substantial and sudden temperature change and stresses, which can cause the container to break or fracture under the temperature stresses. Such breakages reduce productivity, can cause interruptions in the container processing, and can increase down times of the container handling machine for cleaning and maintenance.

SUMMARY

Taking this as a basis, one of the objects of the present application is to provide a method of both filling containers with a liquid filling product as well as for closing the containers with a closure cover, with which, in comparison with known methods, the container is subjected to the flushing gas containing steam for a perceptibly shorter contact time.

The object can be achieved in a method of filling and closing containers at a filling and closing apparatus of a handling station in accordance with at least one possible exemplary embodiment disclosed herein.

In accordance with at least one possible exemplary embodiment, the application relates to a method of filling and closing containers with a filling and closing apparatus of a handling station, with which provision is made at the filling and closing apparatus of a sealable process chamber, with a pressure sensor for detecting or measuring the actual pressure values prevailing in the process chamber.

In this situation, before the initiation of a filling phase, at least the interior of the container arranged in the sealing position at the filling and closing apparatus is evacuated, in an evacuation phase, initially at least once to a negative pressure or a pressure below atmospheric pressure or possibly a very low residual pressure, such as a pressure of 0.05 to 0.15 bar, and then flushed in a flushing phase with steam and/or with a flushing gas containing steam, in such a way that, before the opening of the filling valve for filling the container with the liquid filling material, the flushing gas pressure in the container is increased at least to atmospheric pressure or approximately one bar or the pressure of the surrounding environment where the filling and closing apparatus is located. It should be understood that, in the context of this application, the phrase "atmospheric pressure" refers to standard atmospheric pressure, which is the pressure within the atmosphere at sea level, that is, a pressure of one bar or approximately one bar, such as 1.01325 bar, or, alternatively, about 15 psi, such as 14.696 psi, or refers to actual atmospheric pressure within the atmosphere of the area or place at or in which the filling and closing apparatus is located, which could be higher or lower than standard atmospheric pressure since actual atmospheric pressure is dependent on the environmental conditions at the location of measurement, such as, for example, temperature, humidity, and elevation above or below sea level. Therefore, in accordance with at least one possible exemplary embodiment, the method can include adjusting the pressure in the container and/or the process chamber to a predetermined or desired pressure, which pressure can be equivalent to or essentially or approximately standard atmospheric pressure or the actual atmospheric pressure, which are referred to as "atmospheric pressure" for convenience. In the context of this application, the phrase "negative pressure" refers to any pressure below atmospheric pressure.

Moreover, in the actual filling phase the filling valve is opened, such that the liquid filling material flows into the container which continues to be arranged in the sealing position at the filling and closing apparatus.

After the ending of the filling phase a settling phase is carried out, still at the filling and closing apparatus of the handling station, during which the process chamber is adjusted, such as above the mouth of the container, by steam and/or a gas containing steam, to a carbon dioxide saturation pressure of the filled filling material or a pressure above that.

Following this, after the settling phase, and while still at the filling and closing apparatus of the handling station, the container is closed by the pressing on of a closure cover, under the pressure conditions or essentially the pressure conditions which were set during the settling phase, and before the interior pressure of the process chamber is relieved to atmospheric pressure, wherein, in accordance with at least one possible exemplary embodiment, at least the evacuation phase and/or the flushing phase and/or the settling phase are controlled and/or regulated as a dependency of the actual pressure values detected by the pressure sensor.

In accordance with at least one possible exemplary embodiment, the method allows for the duration of the process steps of the evacuation phase and/or of the flushing phase and/or of the settling phase, such as the flushing of the container with steam between evacuation phases, the imposition of steam on the container up to atmospheric pressure shortly before or at the initiation of the filling phase, and the imposing of steam on the process chamber and the mouth of the container after or at the end of filling, in the settling phase, can be kept as short as possible by pressure-dependent switching. Accordingly, the steam treatment times can be restricted to a minimum as a dependency of the pressure. By using a pressure-dependent control and/or regulation, the quantity of steam blown in, and therefore the energy input into the container, can be reduced to the minimum necessary. In accordance with at least one possible exemplary embodiment, in this situation the method steps immediately following the filling phase, of the removing of the filling support formed in the pusher element and the actual closing of the container, take place while still at the filling and closing apparatus, in the shortest possible process time, or at least a substantially short process time or a relatively short process time.

In other words, in accordance with at least one possible exemplary embodiment, the duration of the different processing steps or phases can be controlled and adjusted based on the actual pressure detected in the process chamber, rather than using fixed durations or times. For example, if the step of flushing with steam or a flushing gas is performed according to a predetermined fixed time or duration, the temperature and heat energy or energy imposed on the container, due to the inherent variations in conditions that can occur due to environmental or material factors or tolerances, could be unnecessarily high, that is, it exceeds a level sufficient to treat or flush the containers in a desired or satisfactory or acceptable manner. In the container handling industry, it is understood that when containers are subjected to thermal stresses or similar, some breakage of the containers will occur. However, by subjecting the containers temperature or energy beyond a level or amount sufficient to treat or flush the containers, the container is unnecessarily subjected to excess thermal stresses or similar, which could result in increased occurrences of breakage of the containers beyond an acceptable minimum level. In other words, unnecessary breakages occur, as well as a waste of time and energy in the filling process, that could be avoided. In accordance with at least one possible exemplary embodiment, the method allows for adjustment and control of the different processing steps or phases such that the actual conditions in the processing chamber and/or container closely follow or approximately match or match optimal or predetermined or minimum conditions sufficient or satisfactory to allow for maximized or fast or quick handling of containers with minimized or low or reduced container damage and/or disruptions in processing and/or waste of time and energy.

The method according to at least one possible exemplary embodiment can make use of the fact that a beverage containing carbon dioxide and with a very low oxygen content or extraneous gas content, filled into a container under vacuum, with which the residual gas content in the container consists predominantly of carbon dioxide, can be filled without excessive foam formation, after the ending of the filling process, and more precisely without excessive foam formation at pressure relief, at a high or substantially fast filling speed.

For this purpose, the container, such as a bottle or beverage bottle or glass bottle, is evacuated in an evacuation phase to a vacuum or pressure in the range of approximately or exactly 0.05 bar to 0.15 bar. Following this, in a flushing phase, flushing of the container takes place, such as with superheated steam under vacuum, in order to remove as far as possible any residual air, or at least to a sufficiently low level or amount of residual air.

Such as, at the end of this flushing procedure of the flushing phase, it is also possible for a specific amount of carbon dioxide to be metered into the steam flow or, separately, at the end of the steam treatment, into the container. Also during and/or at the end of the filling procedure, in the then downstream filling phase, additional carbon dioxide can still be blown under pressure into the container, in order to ensure or promote that, at the end of the filling procedure of the filling phase, a pressure prevails in the container at which, in the settling phase which follows the filling phase in the time sequence, a predetermined or desired saturation pressure is attained or exceeded.

Due to the very pure carbon dioxide atmosphere in the container which is produced in the upstream evacuation and flushing phase, into which a beverage is being filled with few dissolved oxygen fractions or other extraneous gas portions, at the filling of the liquid filling material during the filling phase, and despite the powerful flow turbulence incurred by the rapid inflow, only a very limited amount of foam is incurred. As a result, for example in a pure carbon dioxide pressure atmosphere, the carbon dioxide emerging from the beverage in the form of foam is very rapidly dissolved in the beverage again.

For this purpose, shortly before the opening of the filling valve, in the flushing phase, the vapor pressure in the container is raised to atmospheric pressure, or to a pressure above that. If the filling valve then opens in the filling phase which follows, under these conditions, then, when the cold liquid filling material flows in, a sudden condensation occurs of at least a part volume of the steam or vapor present in the container. As a result, a sudden filling of the container takes place. If filling takes place in such an atmosphere with high turbulence, then initially there is a strong carbon dioxide release, and therefore a transition of carbon dioxide from the liquid phase to the gas phase. As a result of this effect, and of the residual gas atmosphere compressed by the inflowing cold filling material, the pressure in the container rises again. If the pressure in this filling phase exceeds the carbon dioxide saturation phase, then a recarbonization takes place with the carbon dioxide released earlier and the residual carbon dioxide now compressed by the inflowing filling material, which has still remained in the container after the evacuation in the evacuation phase. That is to say, with the increasing rise in pressure, up to the saturation pressure or even beyond that, the carbon dioxide is again dissolved very rapidly into the beverage. Accordingly, the foam formation which is produced is kept within limits or minimized. In order to prevent or minimize the chance of an implosion of the container occurring in conjunction with a pure steam or vapor atmosphere, a small dosage of carbon dioxide into the container will be sufficient, before the filling process in the filling phase. This dosage can also contribute to the carbon dioxide saturation pressure being attained in the settling phase. If, in this situation, only steam is used, then, with the aid of the steam flushing method, an atmosphere can be created in the container which is practically free of residual air or oxygen, or at least minimized to a sufficiently low level or amount.

In addition, with this method the inflow speed of the filling material into the bottle can be regulated by a combination of a flowmeter and a regulating valve.

In accordance with at least one possible exemplary embodiment, the required filling quantity of the filling material is metered into a preliminary vessel and then discharged very rapidly into the bottle, such as if a volumetric measurement by means of a flowmeter is too slow for a very rapid filling. This method can be used at least in situations where, due to the high filling speed, a flowmeter is not capable of attaining an adequate or sufficient degree of measurement precision.

The use of steam as the flushing medium in the flushing phase has the additional effect that micro-organisms which could be harmful to the beverage are killed off to a level sufficient to minimize or prevent contamination of the beverage.

In accordance with at least one possible exemplary embodiment, the beverage or filling material can be filled by way of a tight connection between a filling material tank and the container which is to be filled, by use of a switchable filling valve. In the filling material container, which can also form the carbon dioxide source, a pressure is can be set which corresponds to the carbon dioxide saturation pressure or is above this.

In accordance with at least one possible exemplary embodiment, it is also conceivable for the pressure in the container to be adjusted higher by the addition of carbon dioxide after the evacuation. Depending on the temperature which is regulated in the container after the end of the filling, there then takes place a post-carbonization of the product in the container. In accordance with at least one possible exemplary embodiment, the evacuation process for the removal of the residual air can be replaced by a pure carbon dioxide flushing process.

In accordance with at least one possible exemplary embodiment of the method, due to the substantial pressure difference between the liquid tank and the container, the filling process can take place very rapidly. This leads to short filling times, and therefore to perceptibly smaller-dimensioned filling machines.

The filling speed, if required or desired, can also be regulated by a regulating valve, arranged in the inlet to the container, as a dependency of the volume flow determined by the flowmeter.

In the case of non-carbonized still beverages, the pressure in the storage container can also be the atmospheric pressure, or a pressure which is somewhat above this.

In accordance with at least one possible exemplary embodiment, superheated steam or a mixture of superheated steam and carbon dioxide is used as the flushing gas during the evacuation phase and/or during the flushing phase. As a result, any micro-organisms which may still be present in the container will be killed during or before the filling. On the other hand, the superheated steam condenses very rapidly during the filling, with the result that a vacuum filling is almost achieved. This leads, on the one hand, to a very rapid filling procedure. By the appropriate selection of the carbon dioxide content in the flushing gas, the effect can additionally be achieved that the pressure in the container during the settling phase can be adjusted to the carbon dioxide saturation pressure or above it. This leads to the situation that the filling material or beverage filled after the pressure relief will no longer be degassed. For this purpose, a partial carbon dioxide pressure can be adjusted in the container to a pressure in the range of 0.02 to 0.2 bar, such as 0.05 to 0.1 bar, or approximately either of those pressure ranges, including values within those ranges of tenths or hundredths of a bar. In accordance with at least one possible exemplary embodiment, this step can also be performed after the flushing phase and before the filling phase. This also leads to the situation that, during the settling of the beverage, the pressure in the container rises above the carbon dioxide saturation pressure, such that the beverage will not be degassed in the settling phase, or at least not degassed to a sufficient or predetermined level.

In order to increase the condensation effect in the container still further, provision can also be made for the components of the filling and closing apparatus which come in contact with the steam to be made of a material with low thermal conductivity and/or thermal capacity, such that the condensation effect is created or effected almost exclusively or essentially only in the container.

In accordance with at least one possible exemplary embodiment, provision can be made in this situation that, with the integration of at least one pressure sensor, a regulating circuit is formed, by which at least the evacuation phase and/or the flushing phase and/or the settling phase can be controlled and/or regulated as a dependency of the actual pressure values detected, wherein the filling valve and/or at least one of a first control valve, a second control valve, a third control valve, a fourth control valve, and a fifth control valve, collectively referred to herein as the first to fifth control valves, are provided as actuator elements in the regulating circuit.

In accordance with at least one possible exemplary embodiment, provision can be made in this situation that, with the method, the evacuation phase and/or the flushing phase and/or the settling phase can be controlled and/or regulated by way of preselectable pressure characteristics, with the engagement of the regulating circuit.

In accordance with at least one possible exemplary embodiment, provision can be made that, in the regulating circuit, the actual pressure values detected by the pressure sensor are transmitted to a machine control unit, and there are compared with reference pressure values deposited there, and, based on this, the filling valve and/or at least one of the first to fifth control valves are actuated as the actuator element.

In accordance with at least one possible exemplary embodiment, provision can be made that reference pressure values are set for the respective beginning and the end of the evacuation phase and/or of the flushing phase and/or the settling phase, which are compared with the respective actual pressure values of the evacuation phase and/or the flushing phase and/or the settling phase currently being carried out, and on the reference pressure values being reached, an immediate switch is carried out from the corresponding phase being carried out at present into the present downstream evacuation phase and/or the flushing phase and/or the settling phase.

In accordance with at least one possible exemplary embodiment, provision can be made in this situation for the evacuation phase and/or the flushing phase to be carried out in each case several times over, and specifically, for example, by alternating back-and-forth switching between the evacuation phase and the flushing phase.

In accordance with at least one possible exemplary embodiment, provision can be made in this situation that, depending on the pressure, immediately after reaching a predetermined reference pressure value, a switch over takes place from the phase which is presently being carried out into the following phase which is presently to be carried out. In accordance with at least one possible exemplary embodiment, the switch over can be performed depending on the actual pressure values detected by the pressure sensor.

In accordance with at least one possible exemplary embodiment, provision can be made in this situation that the components in the filling and closing apparatus which are subjected to steam are made of a material with low thermal conductivity and/or thermal capacity.

In accordance with at least one possible exemplary embodiment, provision can be made in this situation that the container, in a sealed filling and closing position, is pressed by a carrier element or carrier arrangement against a sealing element in the sealing position, which comprises a dispensing opening for the liquid filling material, wherein the sealing element is arranged in a pushing element accommodated inside the process chamber such as to be capable of displacement transverse to the vertical axis.

In accordance with at least one possible exemplary embodiment, provision can be made in this situation that a liquid channel is formed in the pushing element, which, with the intermediate engagement of the filling valve, can be connected with a filling material tank by a filling material line or line arrangement.

In accordance with at least one possible exemplary embodiment, provision can be made in this situation that a gas channel is formed in the pushing element, which can be fluidly connected by a first control valve, as well as by a feed line and with the intermediate engagement of a third control valve, to a carbon dioxide source, by which a fourth control valve can be connected to a steam source, and by which a fifth control valve can be connected to a vacuum source.

In accordance with at least one possible exemplary embodiment, provision can be made in this situation that at least one temperature sensor is provided for detecting the actual temperature values prevailing in the process chamber, which are then taken into account as regulating values in the regulating circuit.

"Containers" in the meaning of this application are understood to be any containers, such as bottles, cans, beakers, or similar containers, which in each case may be made of metal, glass, and/or plastic, such as polyethylene terephthalate or PET.

The expression "essentially" or "approximately" signifies in the meaning of this application deviations from the exact value by +/−10%, such as by +/−5%, and/or deviations in the form of changes which are not of significance to the function, or deviations within tolerances.

Further embodiments, advantages, and possible applications of at least one possible exemplary embodiment also derive from the following description of exemplary embodiments and from the figures. In this situation, all the features described or represented as images may be considered to be or to fulfill an object of at least one possible exemplary embodiment, alone or in any desired combination, regardless of their arrangement in the claims or reference to them.

DETAILED DESCRIPTION

Identical reference numbers are used in the figures for elements of at least one possible exemplary embodiment which are the same or have the same effect. In addition, for the sake of easier overview, only reference numbers are represented in the individual figures which are required for the description of the respective figure.

Figure 1:
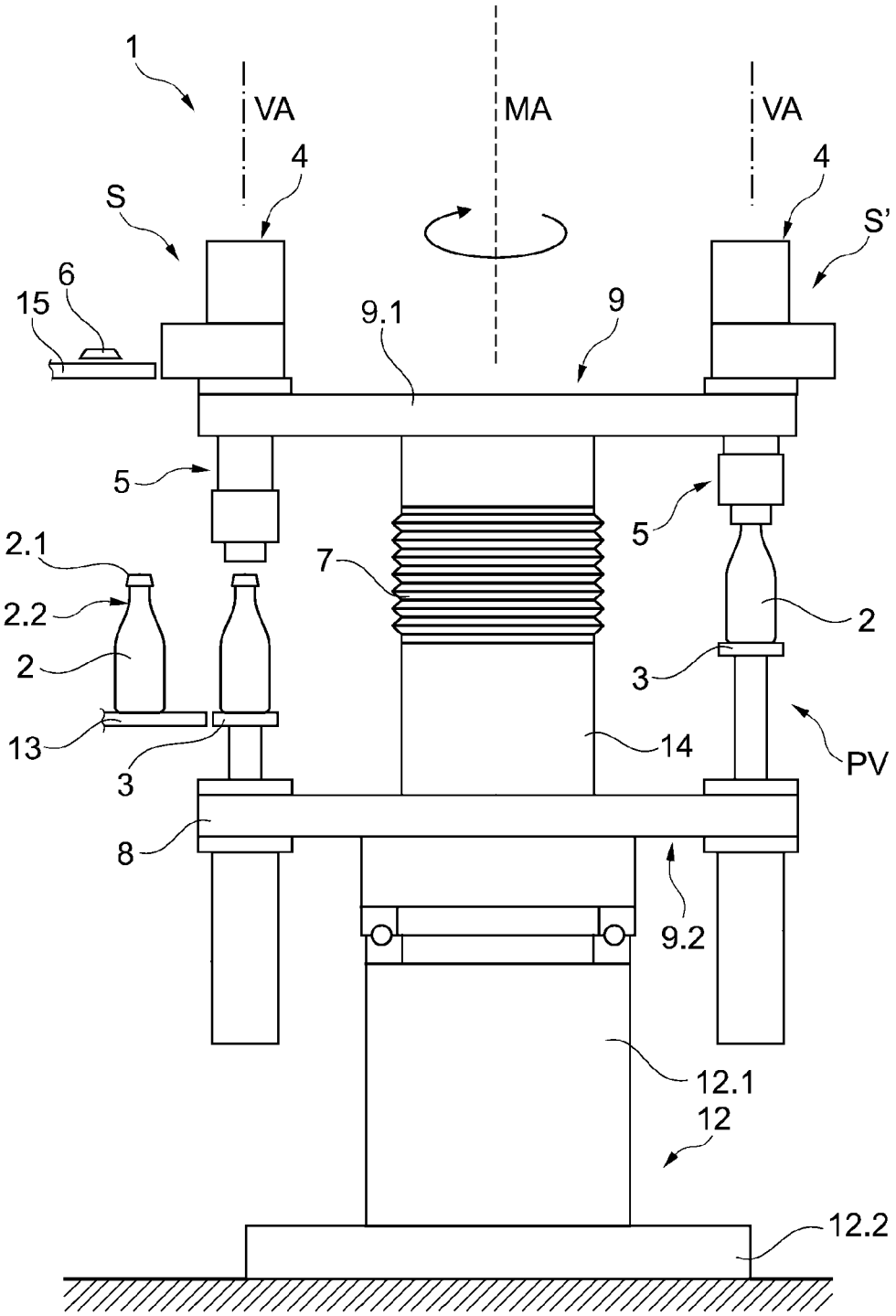
FIG. 1 shows a schematic view of a container handling machine in accordance with at least one possible exemplary embodiment.

The container handling arrangement 1 for filling and closing containers 2 is configured for carrying out the method according to at least one possible exemplary embodiment, and in the example represented according to FIG. 1 is configured as a container handling arrangement or machine of a circulating or rotary design, wherein the machine is understood in this case to be a container handling machine, such as a filling and closing machine 1, that is, configured to fill and close containers 2.

The container handling arrangement 1, configured as a circulating or rotary filling and closing machine, comprises in this situation several handling stations S, S' arranged around a vertical machine axis MA, which in each case extend along a respective vertical axis VA, and are provided at the circumference of a machine carousel 9 driven by a motor such as to rotate. For reasons of easier overview, in FIG. 1, in each case, only two of the several handling stations S, S' are represented. The present invention is not restricted to such embodiment forms, however.

Arranged at each handling station S, S' of the container handling arrangement 1, at a carousel upper part 9.1 of the machine carousel is in each case at least one filling and closing apparatus 4, which in each case extends likewise in the direction along the vertical axis VA of the respective handling station S, S'.

The container handling arrangement 1, configured as a circulating filling and closing machine, further comprises a carousel lower part 9.2, arranged in the vertical direction beneath the carousel upper part 9.1, which comprises a carrier rim 8, provided at the circumference of which are several carrying elements 3 for receiving and carrying the containers 2. In this situation, a carrier element 3 is assigned to each handling station S, S', such that each container 2 which is to be treated is mounted during the handling in a handling station S on a carrier element 3 assigned to the corresponding handling station S, S', such as standing on the carrier element 3.

The container handling arrangement 1, configured as a filling and closing machine, is designed and arranged, for example, to fill containers 2 with a liquid filling material and to subsequently close the containers 6. The present filling and closing machine 1 therefore functions at least for the function sector of closing the containers 2, namely for the closing function such as a crown cork.

With such a filling and closing machine 1, provision is usually made for a container feed device, not represented in any greater detail and arranged upstream in a transport direction. For example, it is also possible for a further handling machine to be located upstream, likewise not represented in the Figures, which is designed to carry out further advanced handling steps of the containers 2, such as, for example, cleaning, sterilization, drying, or inspection of the containers or the like.

The containers 2 are, as a rule, conveyed to the filling and closing machine 1 by transport devices, such as transport belts, and there are transferred on the inlet side by transport elements 13, such as an inlet star, only partially represented in FIG. 1, to the actual filling and closing machine 1. After running through the filling and closing machine 1, in the manner described hereinafter, i.e., after the filling and closing of the individual containers 2, the containers 2, closed with a closure cover 6, such as a crown cork, are taken over on the outlet side of the filling and closing machine 1 by a further transfer element, not represented in any further detail and provided downstream of the filling and closing machine 1 in the transport direction, such as an outlet star, and transported away in a manner known and suitable to the container filling industry.

Figure 2:
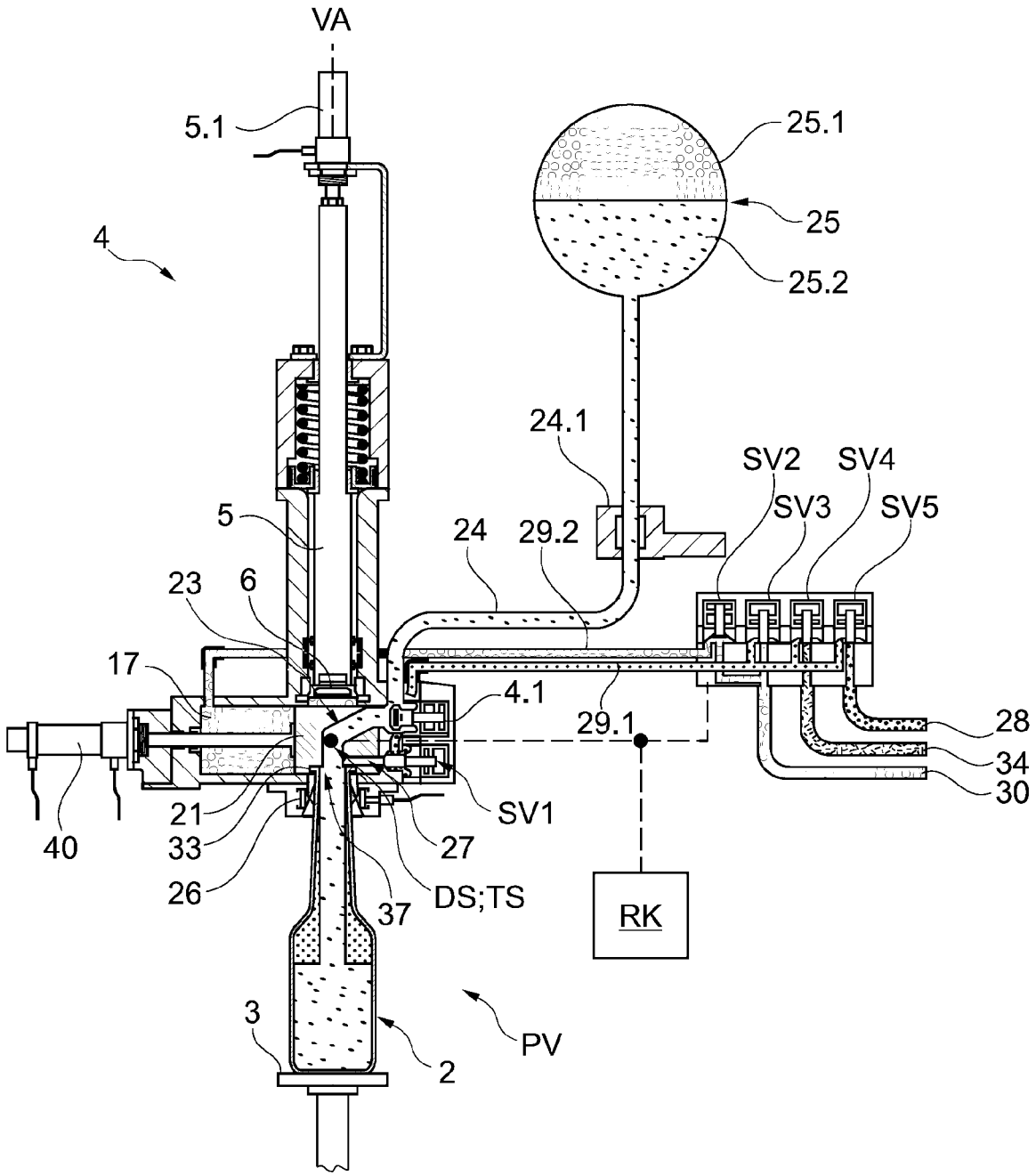
FIG. 2 shows an example of a filling and closing apparatus in accordance with at least one possible exemplary embodiment.
Figure 3:
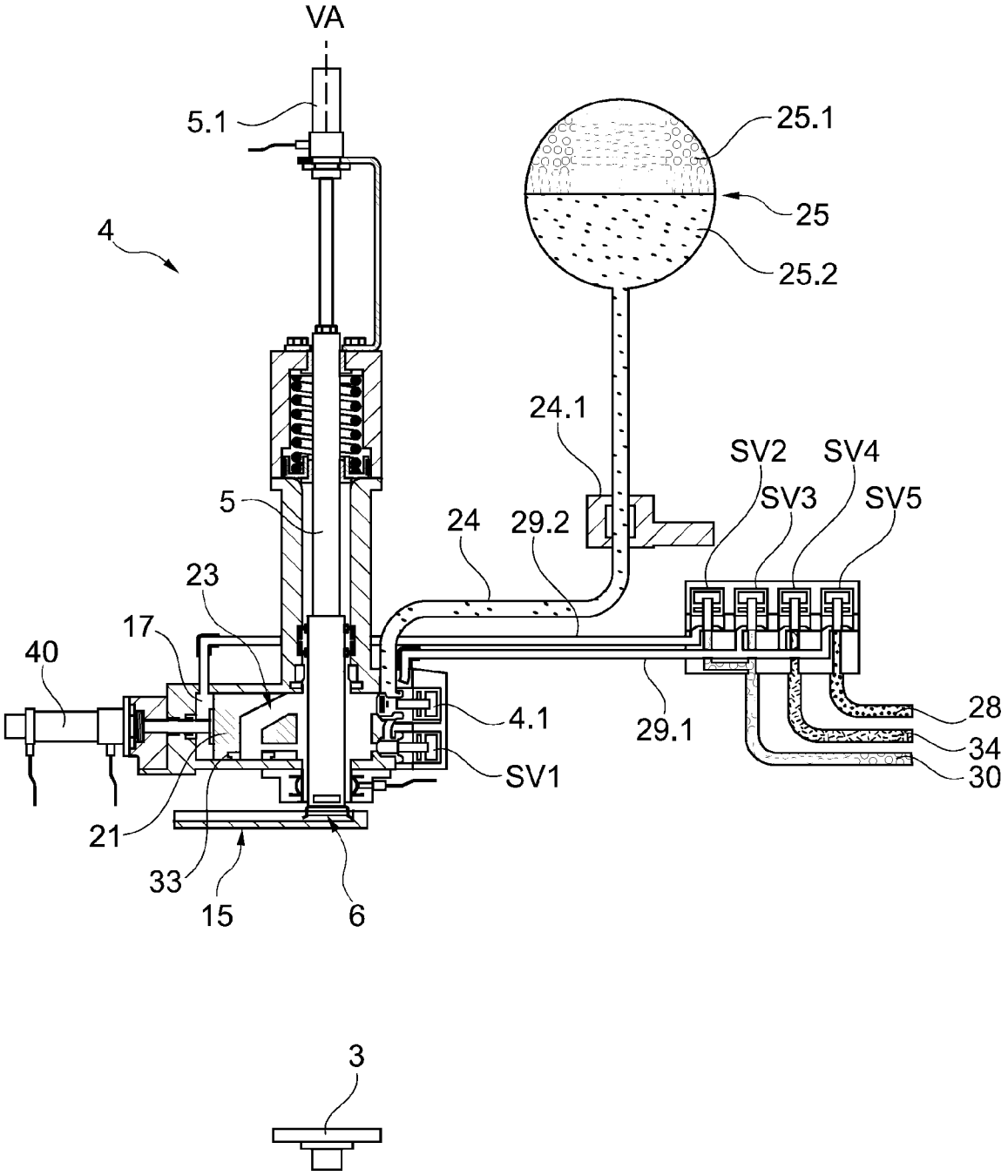
FIG. 3 shows a first phase of a filling and closing procedure performed using the filling and closing apparatus shown in FIG. 2.

With the container handling arrangement 1, configured as a filling and closing machine, such as with the filling and closing apparatus 4 provided at each handling station S, S', there are further connected a filling material feed, as represented in FIG. 2 or 3, for feeding the liquid filling material, and a closure cover feed 15 for feeding the closure covers 6, configured as crown corks. For reasons of easier overview, the closure cover feed 15 for feeding the individual crown corks 6, which feed procedure can take place in a known manner, is only represented in FIG. 1 schematically and in sections.

With the embodiment variant represented in FIG. 1 of the container handling arrangement 1, configured as a filling and closing machine, in each case the machine carousel 9 is mounted such as to rotate about a central column 14, extending along the vertical mid-axis MA, on a machine socket 12, wherein the machine socket 12 comprises in the present case, for example, a standing foot 12.1 and a machine foundation 12.2, connected to the standing foot 12.1 and mounted on the ground substrate.

Arranged in the region of the central column 14, in the embodiment represented of the container handling arrangement 1, configured as a filling and closing machine, is a height adjustment device 7, by which the carousel upper part 9.1 and the carousel lower part 9.2 can be moved in the vertical direction relative to one another along the mid-axis MA, in order to be able to adjust the container handling arrangement 1 to different container formats, such as to different heights of containers 2. In this situation, the height adjustment by the height adjustment device 7 and the adaptation of the machine carousel 9 to different container heights can be carried out in a known manner.

Each filling and closing apparatus 4 arranged at a respective handling station S, S' comprises at least one filling valve 4.1, which is also shown in FIGS. 2 and 3, and at least one closing apparatus 5, arranged in a vertical direction above the containers 2, which are to be filled and closed, wherein the closing apparatus 5 takes over the function of a closing punch such as in the closing process of the containers 2.

The filling and closing apparatus 4 can therefore also be understood as a combined filling and closing tool, such as a combined tool, which comprises both the tool components for the filling as well as the tool components for closing the containers 2. The filling valve 4.1 and the closing apparatus 5, which in each case form a tool component for the filling and a tool component for the closing, are configured such as components integrated in the filling and closing apparatus 4. A possible embodiment of a filling and closing apparatus 4 configured as such a combined tool is shown in rough sketch form in FIGS. 2 and 3.

In this situation, provision can be made for the carrier element 3 and the closing apparatus 5 to be arranged such as to exercise a controlled movement relative to one another oriented in the direction of the vertical axis VA of the handling station S, S', and specifically in such a way that the carrier element 3 and the closing apparatus 5, due to the controlled relative movement, and starting from a starting position, adopt further positions relative to one another, namely at least one filling and closing position PV.

In the example from FIG. 1, the starting position is represented in each case for the handling station S, S'. In accordance with at least one possible exemplary embodiment, the container handling arrangement 1 is configured such as both to fill the containers 2 at a respective handling station S, S' as well as close them. In this situation, for example, in the filling and closing position PV, at least one evacuation phase and/or one flushing phase and/or one filling phase and/or one settling phase is/are carried out, and the container 2 is closed in a closing procedure with a closure cover 6. Therefore, during the preliminary handling, for example, in an evacuation and flushing phase of the actual filling phase and during the closing or sealing by a closure cover 6, the containers do not need to be moved vertically, since the respective container 2 can remain in the filling and closing position PV at the handling station S for all of the part process steps referred to heretofore.

FIG. 2 shows, in accordance with at least one possible exemplary embodiment, a possible embodiment variant of a filling and closing apparatus 4 being used in this present container handling arrangement 1, with which a container 2 which is to be handled, such as to be filled and closed, can for this purpose be moved into the filling and closing apparatus 4 from its free-end under side, in such a way that the container mouth 2.1 can be arranged inside the process chamber 17, which can be sealed in relation to the outside atmosphere, in order to remain there during the entire filling and closing procedure, such as during the evacuation phase and/or the flushing phase and/or the filling phase and/or the settling phase.

In accordance with at least one possible exemplary embodiment, in this situation the container 2, in its filling and closing position PV shown in FIG. 2, is pressed by the carrier element 3, such as against a sealing element 33 in the sealing position, which surrounds concentrically a dispensing opening 37 for the liquid filling material, wherein the sealing element 33 is arranged at a pusher element 21, accommodated inside the process chamber 17, which can be displaced transverse to the vertical axis VA in a controlled and/or regulated manner.

The pusher element 21 can, in this situation, also comprise a liquid channel 23, which is connected to a liquid tank 25 via a filling material line 24, with the intermediate engagement of the filling valve 4.1. In this situation, a flowmeter 24.1 can be assigned to the filling material line 24, by which the volume flow of liquid filling material, that is, the filling material quantity per time unit, can be detected, which liquid filling material is being fed via the filling material line 24 out of the filling material tank 25 to the liquid channel 23.

In addition to the liquid channel 23, the pusher element 21 can also comprise a gas channel 27, which is fluidically or fluidly connected via a first control valve SV1 and via a first feed line 29.1, and with the intermediate engagement of a third control valve SV3, to a carbon dioxide source 30, such as, for example, the gas chamber 25.1 of the filling tank 25, via a fourth control valve SV4 to a steam source 34, and via a fifth control valve SV5 to a vacuum source 28.

Furthermore, the process chamber 17 can be fluidically connected to the carbon dioxide source 30 via a second feed line 29.2 and with the intermediate engagement of a second control valve SV2 or of the third control valve SV3.

In this situation, the sealable process chamber 17 can comprise at least one pressure sensor DS for detecting the actual pressure values prevailing in the process chamber 17. In accordance with at least one possible exemplary embodiment, the at least one pressure sensor DS is located in the fluid channel 23 of the pusher element 21.

For this purpose, the at least one pressure sensor DS, together with the filling valve 4.1 and at least one of the first to fifth control valves SV1 . . . SV5, forms a regulating circuit RK, such as a pressure regulating circuit, by which at least the evacuation phase and/or the flushing phase and/or the settling phase can be controlled and/or regulated as a dependency of actual detected pressure values, wherein the filling valve 4.1 and/or at least one of the first to fifth control valves SV1 . . . SV5 are provided as actuators in the regulating circuit RK, such as in the pressure regulating circuit.

In this situation, the sealable process chamber 17 can also comprise at least one temperature sensor TS for detecting the actual temperature values prevailing in the process chamber 17. For example, the at least one temperature sensor is arranged in the liquid channel 23 of the pusher element 21. In this situation, the actual temperature values detected by the temperature sensor TS can flow as controlled variables into the regulating process of the pressure regulating circuit. In accordance with at least one possible exemplary embodiment, for example, by taking account of a combination of the actual pressure values detected as well as the actual temperature values detected, cooling and condensation effects in the container 2 can be compensated for.

The pusher element 21 can be pushed by means of a drive 40, for the filling phase, into a position beneath the closing apparatus 5, such as, for example, essentially into a position along the vertical axis VA, in such a way that both the liquid channel 23 as well as the gas channel 27 of the pusher element 21 are in contact laterally at the filling valve 4.1 and the first control valve SV1 in solid contact and in a sealing position.

In accordance with at least one possible exemplary embodiment, the pusher element 21 can also be drawn back laterally by the drive 40 for a closing procedure, out of the centric position along the vertical axis VA, such as, for example, in a horizontal direction pointing away from the filling valve 4.1, such that the closing apparatus 5 can be freely displaceable downwards in the direction of the container 2 arranged in the sealing position at the filling and closing apparatus 4.

Figure 10:
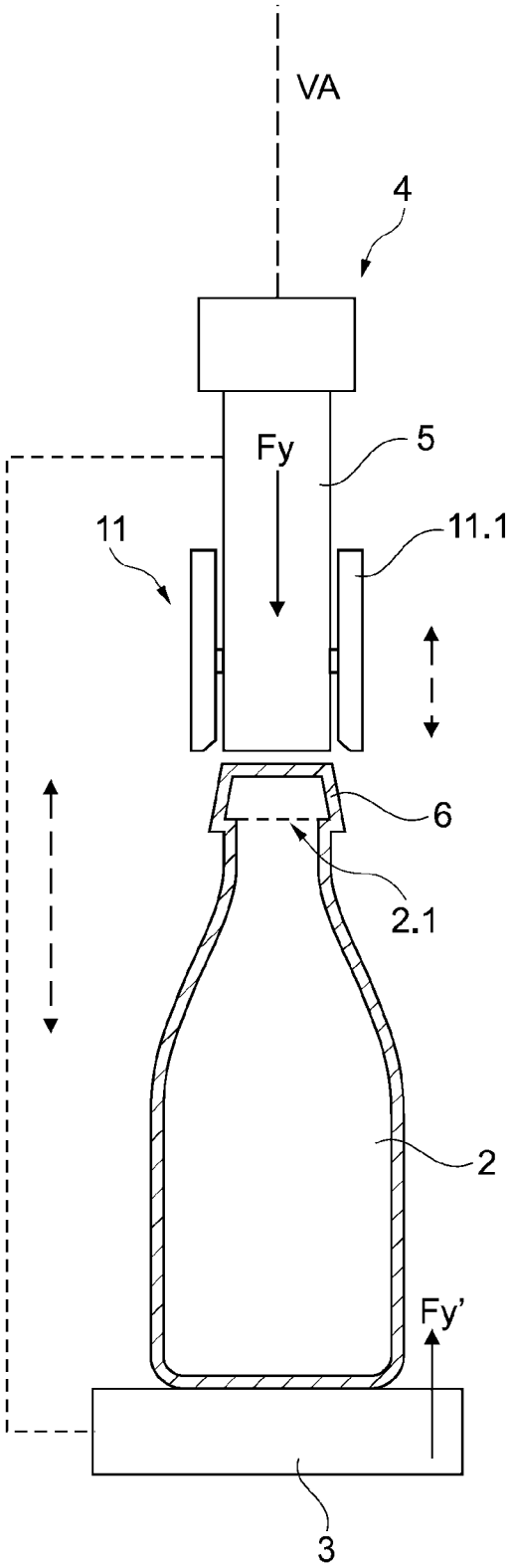
FIG. 10 shows, in an isolated view, a simplified and rough schematic sketch representative of a closing mechanism designed to produce a closing procedure on the basis of a handling station in accordance with at least one possible exemplary embodiment.
Figure 11:
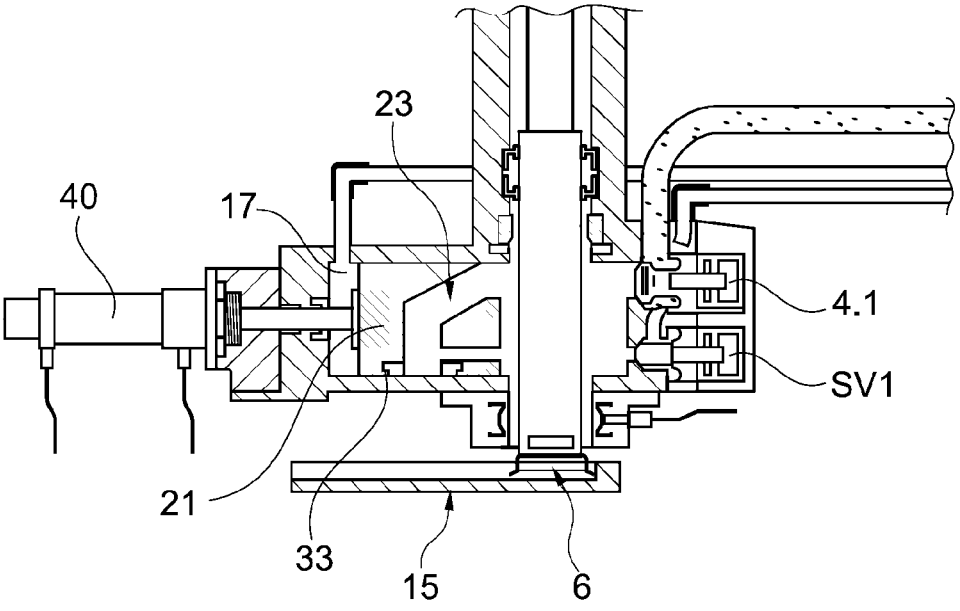
FIG. 11 shows, in an enlarged view, a filling and closing apparatus in accordance with at least one possible exemplary embodiment.

For better understanding of the closing procedure or the closing phase of the filled container 2 with the closing cover 6, the interaction between the carrier element 3 and the closing apparatus 5, as well as the interworking of the various mechanisms, is represented schematically in FIG. 10, wherein the movements and relative movements are performed vertically along the vertical axis VA.

As a result of the controlled relative movement, as indicated in FIG. 10, for example, by the double arrow with broken lines, of the carrier element 3 and of the closing apparatus 5 relative to one another, the distance interval between the carrier element 3 and closing apparatus 5 can be changed in a controlled manner.

The container 2, filled and now to be closed, is arranged during the closing phase between the carrier element 3 and closing apparatus 5, wherein the performance of the different sequential function steps generally referred to as "sealing," "filling," and "closing" also change in relation to the container 2.

Due to the controlled relative movement, the contact pressure required or sufficient during the closing process is produced between the crown cork 6 and container 2. In this situation, the container 2 is tensioned between the carrier element 3 and closing apparatus 5, with the crown cork 6 positioned on the container mouth 2.1, wherein the closing apparatus 5 exerts and exercises a closing force Fy, which takes effect from above onto the crown cork 6, and therefore also onto the container 2. The container 2 is held by the carrier element 3 with a retaining force Fy', directed upwards and counteracting the closing force Fy, wherein the closing force Fy and the retaining force Fy' take effect in interaction such as to press the crown cork 6 onto the container mouth 2.1 and then cause the tight closing of the container 2.

As can be seen from FIG. 10, the carrier element 3 and/or closing apparatus 5 are configured so as to be movable by raising and lowering, and can therefore cover a movement path along the vertical axis VA. In order to initiate the vertical movement onto the closing apparatus 5, this can interact with a drive device 5.1 in the region of a free face side, facing away from the process chamber 17. Moreover, the carrier element 3 and/or closing apparatus 5 produce a force oriented along the vertical axis VA, namely the holding force Fy' taking effect upwards, and, respectively, the displacement force Fy taking effect perpendicularly downwards.

The plastic deformation of the edge of the crown cork, which is necessary for the final tight closure of the container with the crown cork 6, takes place by an at least partial immersion or insertion of the crown cork 6 into the draw ring 11.1 of the draw ring arrangement 11. For this purpose, for example, the draw ring 11.1 can be configured as fixed in position and the container is moved upwards relative to the draw ring 11.1. As an alternative, the draw ring 11.1 can be configured as movable in the vertical direction, as a result of which it moves, for example, along the vertical axis VA relative to the non-moving crown cork 6 and to the container. The possible movement of the draw ring 11.1 is indicated in FIG. 10 by the double arrow with the single broken line. As an alternative, both the draw ring 11.1 as well as the carrier element 3 and closing apparatus 5 move.

In accordance with at least one possible exemplary embodiment, the closing apparatus 5 is configured as a magnetic punch, which, at its free end facing towards the carrier element 3, in each case magnetically holds the closure cover 6, to be pressed onto the container mouth 2.1, such as the crown cork, before the closure cover 6 is fixed to the respective container 2 by means of the draw ring arrangement 11. As an alternative, the closing apparatus 5 can also hold the closing apparatus 6 by the force effect of negative air pressure or vacuum force or suction.

During the filling operation, in the filling material tank 25, as shown in FIG. 2, an upper gas chamber 25.1 and a lower liquid chamber 25.2 are formed. If in this situation the container handling arrangement 1 serves to carry out the pressure filling of the liquid filling material into the containers 2, then the upper gas chamber 25.1 is subjected to an inert gas, such as, for example, carbon dioxide gas, which is under filling pressure. The pressure of the inert gas is controlled or regulated. The filling material is fed to the filling material tank 25 via a supply line, which is not represented in any greater detail.

Furthermore, provided beneath the dispensing opening 37 is a neck sealing device 26, which can be actuated in a controlled and/or regulated manner, by which the respective container 2 can be sealed beneath its container mouth 2.1 in the region of its corresponding container neck 2.2, and, as a result, the process chamber 17, for example, is also sealed against the surrounding environment in the sealed filling and closing position PV. Since the container mouth 2.1 in the sealed filling and closing position PV is therefore arranged inside the process chamber 17, this can also be understood as a sealing of the container 2. In other words, in some filling machines, the filling or processing chamber or path or area has an opening to the surrounding environment, which opening has an annular sealing structure. The mouth of a container, such as a bottle, is brought into sealing engagement with the sealing structure, wherein the lip or edge immediately about the top opening in the container is in contact with the sealing structure. No portion of the container is inserted into the filling or processing chamber. As a result, the interior of the container and the filling or processing chamber are sealed off from the surrounding environment. In contrast, in the embodiment shown in FIG. 2, the container mouth 2.1 is inserted into the process chamber 17, and instead the container neck 2.2, which protrudes generally radially or laterally out beyond the container mouth 2.1, is brought into sealing engagement with the neck sealing device 26. The container neck 2.2 and the neck sealing device 26 seal off the process chamber 17 from the surrounding environment, and, since the container mouth 2.1 is located in the process chamber 17, also seal off the interior of the container 2 from the surrounding environment.

Figure 9:
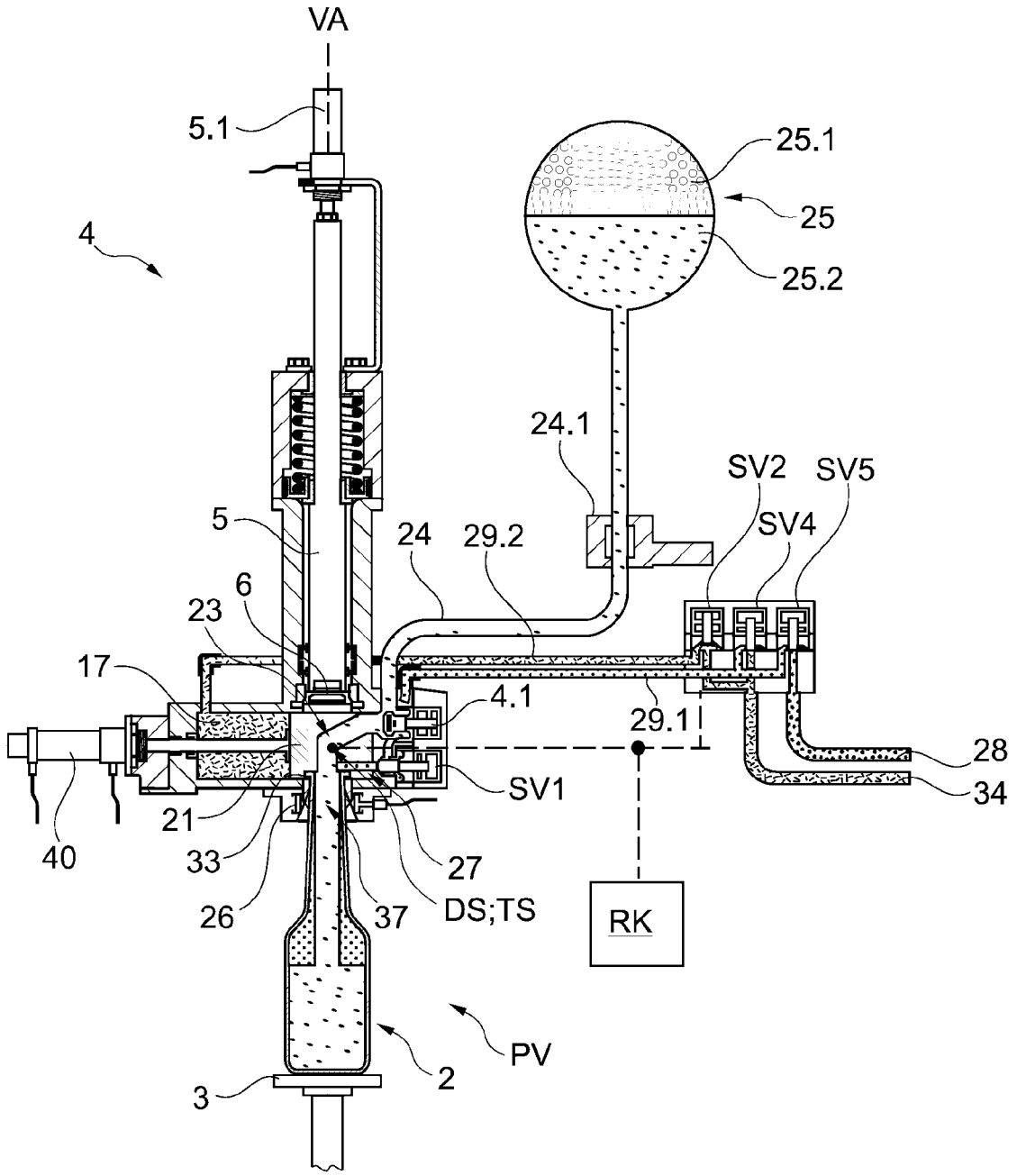
FIG. 9 shows an example of a filling and closing apparatus in accordance with at least one possible exemplary embodiment.

In differentiation to the embodiment variant of the filling and closing apparatus 4 from FIG. 2, the embodiment variant of the filling and closing apparatus 4 from FIG. 9 does not comprise any feed line for a carbon dioxide source 30, but only for a vacuum source 28 and a steam source 34, such that here, during the flushing phase and/or the settling phase, a pure steam imposition of both the container 2 as well as of the process chamber 17 takes place, and no mixing of carbon dioxide via the carbon dioxide source 30, which is not present in this case.

For this purpose, with the method for filling and closing containers 2, in accordance with at least one possible exemplary embodiment, at the filling and closing apparatus 4 of the handling station S, S', and before the initiation of a filling phase, at least the interior of the container 2 arranged in the sealing position at the filling and closing apparatus 4, is evacuated in an evacuation phase initially at least once to a negative pressure, such as in the range of 0.05 to 0.15 bar of residual pressure, or essentially or approximately 0.05 to 0.15 residual pressure and then, in a flushing phase, is flushed with steam and/or flushing gas containing steam, in such a way that, before the opening of the filling valve 4.1 in order to fill the container 2 with the liquid filling material, the flushing gas pressure in the container 2 is increased at least to atmospheric pressure, that is, it is raised. Following this, in the actual filling phase, the filling valve 4.1 is opened, such that the liquid filling material flows into the container 2, which continues to be held in the sealing position at the filling and closing apparatus 4.

After the ending of the filling phase, a settling phase is carried out while still at the filling and closing apparatus 4 of the handling station S, in which the process chamber 17 is adjusted to a pressure, such as above the mouth of the container 2, by steam and/or gas containing steam, which pressure is at a carbon dioxide saturation pressure of the filled filling material or above it.

Furthermore, following this and after the settling phase, the container 2 is closed while still at the filling and closing apparatus 4 of the handling station S, by the pressing on of a closure cover 6 under the pressure conditions adjusted and set during the settling phase, before the internal pressure of the process chamber 17 is relaxed to atmospheric pressure.

According to at least one possible exemplary embodiment, in this situation at least the evacuation phase and/or the flushing phase and/or the stirring phase are controlled and/or regulated as a dependency of the actual pressure values detected by the pressure sensor DS.

For this purpose, the at least one pressure sensor DS, together with the filling valve 4.1 and at least one of the first to fifth control valves SV1 . . . SV5, form a regulating circuit RK, such as a pressure regulating circuit, by which at least the evacuation phase and/or the flushing phase ad/or the settling phase can be controlled and/or regulated as a dependency of the actual pressure values detected, wherein the filling valve 4.1 and/or at least one of the first to fifth control valves SV1 . . . SV5 are provided as actuators in the regulating circuit RK, such as in the pressure regulating circuit.

According to at least one possible exemplary embodiment, provision is made in this situation that the container handling arrangement 1 is configured such that the evacuation phase and/or the flushing phase and/or the settling phase are controlled and/or regulated in accordance with preselectable pressure characteristics, with the incorporation of the regulating circuit RK.

In accordance with at least one possible exemplary embodiment, for the regulating circuit RK, the actual pressure values detected by the pressure sensor DS are transferred to the machine control unit, not shown in the figures, and compared with reference pressure values stored there, and, based on this, the filling valve 4.1 and/or at least one of the first to fifth control valves SV1 . . . SV2 are actuated as the actuator. In this situation the pressure sensor DS provides the regulating parameter of the regulating value for the regulating circuit RK. It should be noted that what is meant by "actual" pressure value or values is the detected pressure in at least the process chamber 17 or liquid channel 23, as detected by the pressure sensor DS, during operation of the filling and closing arrangement 4, such as during a filling or a closing process, or before, after, or in between such processes. It should further be noted that what is meant by "reference" pressure value or values is a predetermined or preselected or desired or optimal or sufficient pressure value stored in a storage arrangement, such as a computer control arrangement or machine control unit. The reference pressure values, in accordance with at least one possible exemplary embodiment, are selected or set in order to achieve a desired or optimal operation of the filling and closing arrangement, which values are selected based on different factors, such as, for example, the type of filling material, the type of container to be filled and closed, the type of flushing or other treatment media, and the surrounding environment.

In accordance with at least one possible exemplary embodiment, provision can be made in this situation that reference pressure values are determined for the respective beginning and the end of the evacuation phase and/or the flushing phase and/or the settling phase, which are compared with the respective actual pressure values of the evacuation phase and/or the flushing phase and/or the settling phase currently being carried out, and, on reaching the reference pressure values, an immediate or essentially immediate or fast switching takes place from the corresponding evacuation phase and/or the flushing phase and/or the settling phase currently being carried out, into the phases which follow on from these.

In this situation, provision can be made such as that the evacuation phase and/or the flushing phase are carried out several times, and, in accordance with at least one possible exemplary embodiment, by alternating back and forth, such as by switching between the evacuation phase and the flushing phase.

In this situation it is ensured or promoted that, as a dependency of the pressure, immediately or essentially immediately after reaching a predetermined reference pressure value, a switch takes place from the phase currently being carried out into the phase following, in the filling and closing process, such as dependent on the actual pressure values determined.

In greater detail, for example with a filling and closing apparatus 4 represented in FIG. 2, in accordance with at least one possible exemplary embodiment, the method runs according to the steps or processes shown in FIGS. 3, 4, 5, 6, 7, and 8.

As can be seen from FIG. 3, first the closing element 5 is moved into its lower position, for example for the magnetic take-up of a closure cover 6.

For this purpose the pusher element 21 is located in its drawn back position, in which the closing apparatus 5 can be moved out freely movable axially along the vertical axis VA downwards over the dispensing opening 37, in order thereby to take up the closure cover 6, such as from the closure cover feed 15.

The filling valve 4.1 and all the control valves SV1 . . . SV5 are closed in this situation. As shown in FIG. 3, the closure cover 6 is held magnetically at the closing apparatus 5, though, in accordance with at least one possible exemplary embodiment, other holding arrangements or structures could be used, such as a vacuum or negative pressure holding arrangement.

The closure cover 6 is therefore sterilized by the steam treatment, described in greater detail hereinafter, before and during the closing procedure.

Figure 4:
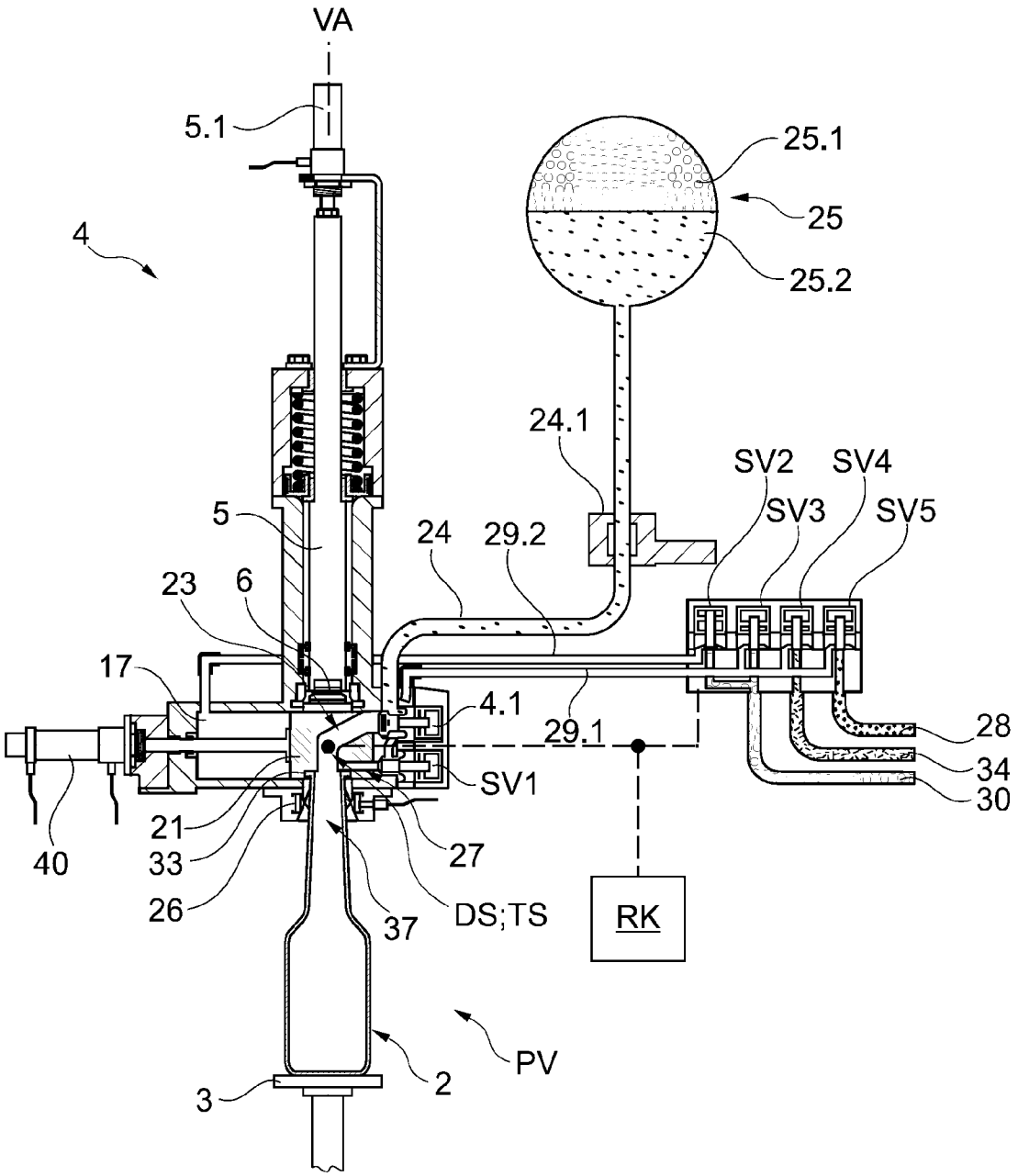
FIG. 4 shows a second phase of a filling and closing procedure performed using the filling and closing apparatus shown in FIG. 2.

Following this, the closing apparatus 5, together with the closure cover 6 held by it, moves into its raised position. Following this, the pusher element 21 is moved underneath the closing apparatus 5 and disposed in close contact with the filling valve 4.1 and the first control valve SV1. In addition to this, the container 2 is then positioned centrically on the carrier element 3 under the filling and closing apparatus 4 and, by raising the carrier element 3, is brought into the sealing position with the filling and closing apparatus 4, such as with the pusher element 21, as shown in FIG. 4, for example.

Figure 5:
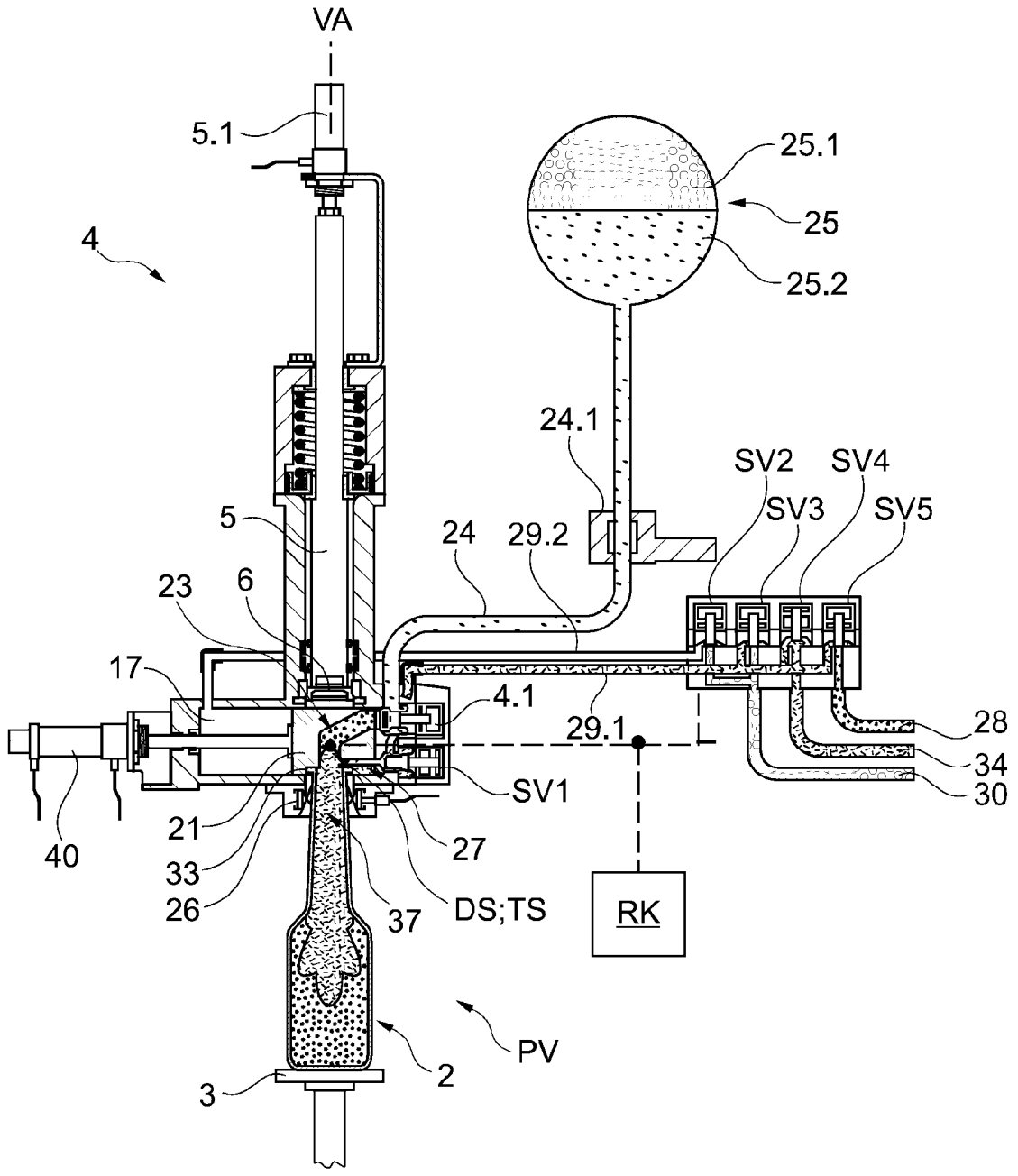
FIG. 5 shows a third phase of a filling and closing procedure performed using the filling and closing apparatus shown in FIG. 2.

Following this, the neck sealing device 26 is subjected to pressure, such that sealing of the container 2 takes place in the region of its container neck 2.2 against the surrounding environment, as shown in FIG. 5, for example. Following this, in the exemplary embodiment shown, the container 2 is evacuated by opening the first control valve SV1 and fifth control valve SV5 in the evacuation phase to a reference pressure value or predetermined pressure value, such as a value in the range of 0.05 to 0.15 bar, or essentially in the range of 0.05 to 0.15 bar, or approximately in the range of 0.05 to 0.15 bar, including values in tenths and hundredths of a bar. The determination of the actual pressure in this situation can be performed by the pressure sensor DS, which is available for the regulating circuit RK.

Following this, with the first control valve SV1 continuing to be open, the fifth control valve SV5 is closed, and, in this situation, simultaneously or almost simultaneously, the fourth control valve SV4 is briefly opened in order to initiate the flushing phase, which is pressure-controlled by the regulating circuit RK, until a pressure rise to at least atmospheric pressure, or other pre-selected or predetermined pressure, takes place in the container 2, such that the container is flushed with steam from the steam line 34. If appropriate, in this situation some carbon dioxide is delivered by the controlled opening of the third control valve SV3, in order to ensure or promote thereafter that the carbon dioxide pressure in the container or bottle in the settling phase rises above the saturation pressure of the carbon dioxide. These process steps are repeated for as long as until a desired oxygen reduction is attained in the interior of the container 2. In this situation, therefore, the initiating of the flushing phase and/or evacuation phase takes place, according to at least one possible exemplary embodiment, pressure-controlled and/or pressure-regulated as a dependency of the actual pressure values detected by the pressure sensor DS. To conclude this handling phase, in accordance with at least one possible exemplary embodiment, the container is completely or essentially filled with steam.

Figure 6:
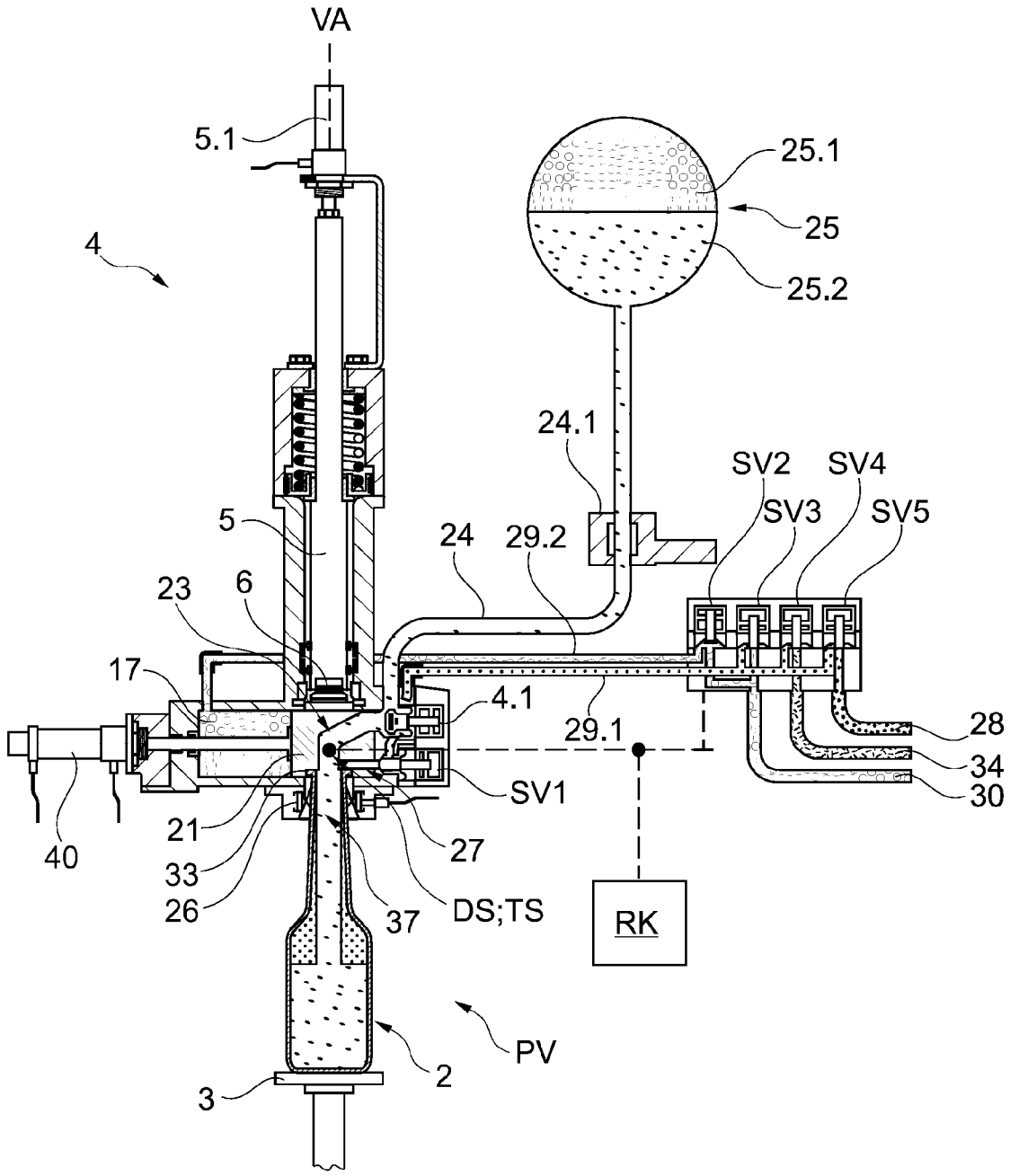
FIG. 6 shows a fourth phase of a filling and closing procedure performed using the filling and closing apparatus shown in FIG. 2.

As can be seen from FIG. 6, in order to initiate the filling phase, the first control valve SV1 and the fourth control valve SV4 are now closed, and the filling valve 4.1 is opened, in order to deliver the filling material to the container 2. In addition to this, with the filling valve 4.1 open, the second control valve SV2 is opened, and the processing chamber 17 is subjected to pre-stressing gas from the carbon dioxide source. After the ending of the filling process, the filling valve 4.1 is closed again, wherein the quantity of the filling material being delivered is determined by way of the volumetric flowmeter 24.1. As an alternative to this, however, the product can also be delivered immediately from a metering chamber. In this case, the volumetric measurement takes place at the delivery of the filling material into the metering chamber, and not in the filling element 4.

Optionally, during the filling phase and filling process, the container 2 can be subjected to carbon dioxide by regulated opening of the third control valve SV3. After the closing of the filling valve 4.1, the settling phase takes place, in which the beverage is settled and the pressure in the container 2 rises to above the carbon dioxide saturation pressure.

Figure 7:
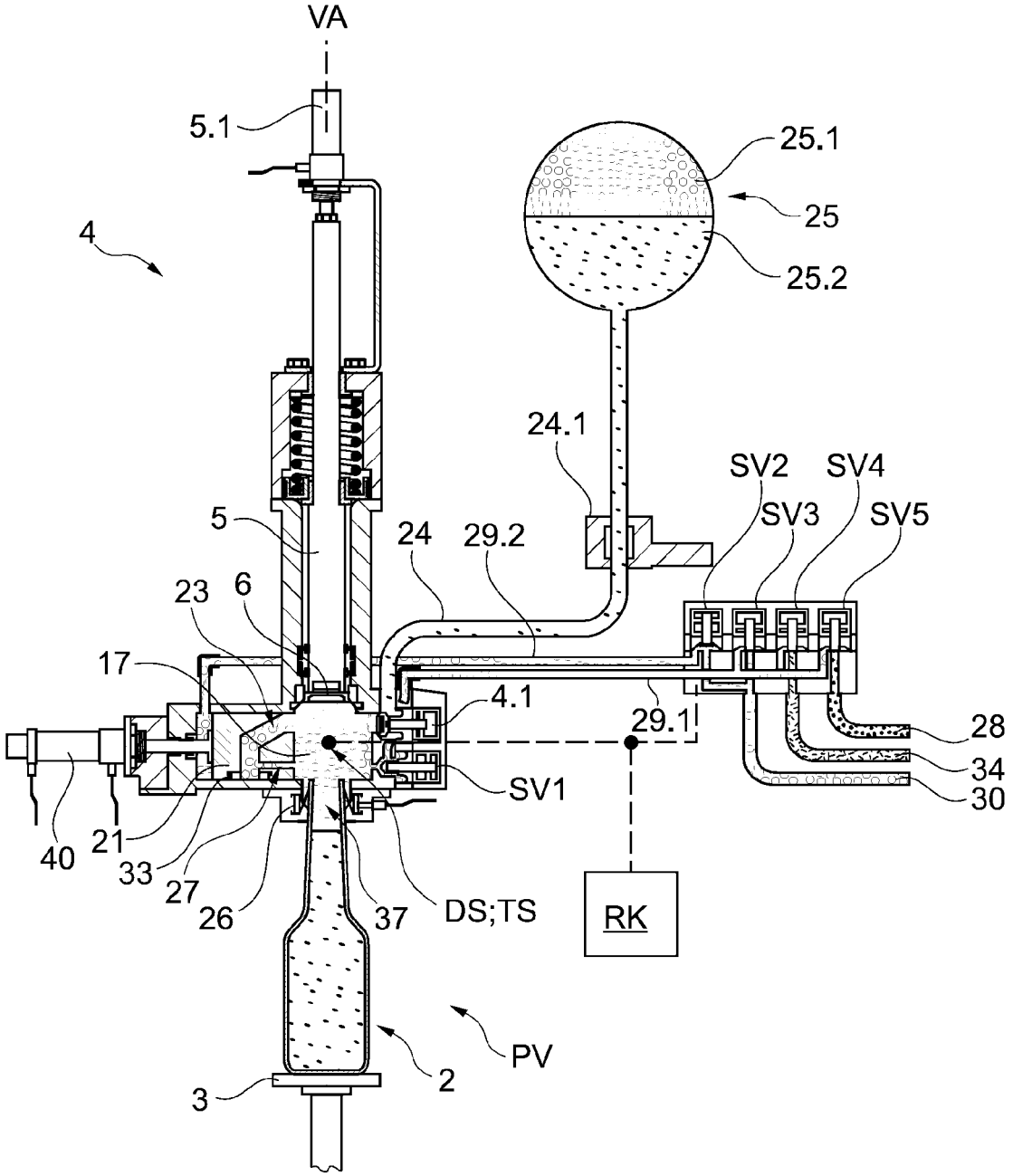
FIG. 7 shows a fifth phase of a filling and closing procedure performed using the filling and closing apparatus shown in FIG. 2.

For the maintaining of the pressure conditions after the filling phase, in the following settling phase, the second control valve SV2 remains open for the imposing of pre-stressing gas on the process chamber 17. Furthermore, the first and third control valves SV1, SV3 are opened, such that a pressure equalization takes place between the container 2 and the process chamber 17. In this situation, according to at least one possible exemplary embodiment, the initiation of the settling phase takes place in a pressure-controlled and/or pressure-regulated manner, as a dependency of the pressure values detected by the pressure sensor DS. Even before the pusher element 21 is pushed back again, in this situation the third control valve SV3 is closed, while the first control valve SV1 and second control valve SV2 continue to remain open, as shown in FIG. 7, for example.

Following this, with the first control valve SV1 still opened, the second control valve SV2 is closed, and the closing apparatus 5, with the closure cover 6 held on it, is placed onto the container mouth 2.1, and, in accordance with the process explained heretofore in connection with FIG. 10, is first pressed onto the container 2 with the necessary force, and then, by plastic deformation of the edge of the closure cover 6, is connected tight to the container.

Figure 8:
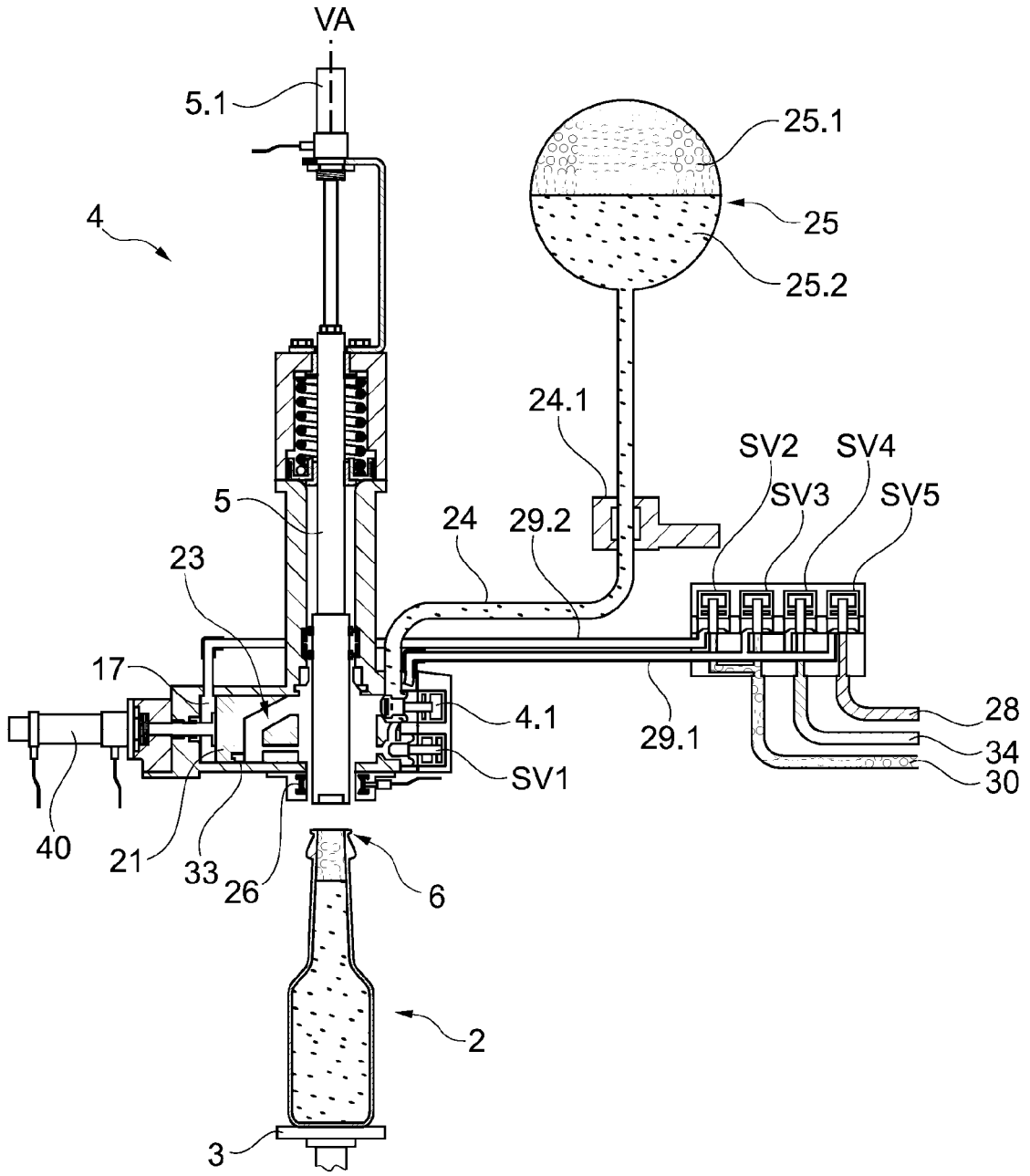
FIG. 8 shows a sixth phase of a filling and closing procedure performed using the filling and closing apparatus shown in FIG. 2.

Finally, with the first control valve SV1 continuing open, the container 2 is released and lowered downwards by the carrier element 3, as shown in FIG. 8, for example.

The invention has been described heretofore on the basis of exemplary embodiments. It is understood that a large number of modifications and derivations are possible without thereby departing from the scope of protection of the invention defined by the claims. The contents of the claims are declared to be the object of the description.

The following is at least a partial list of components shown in the figures and their related reference numerals: container handling device 1; container 2; container mouth 2.1; container neck 2.2; carrier element 3; filling and closing apparatus 4; filling valve 4.1; closing apparatus 5; drive device 5.1; closure cover 6; height adjustment device 7; carrier rim 8; machine carousel 9; carousel upper part 9.1; carousel lower part 9.2; drawing ring arrangement 11; drawing ring 11.1; machine socket 12; standing foot 12.1; machine foundation 12.2; transfer element 13; central column 14; closure cover delivery 15; process chamber 17; pusher element 21; liquid channel 23; filling material line 24; flowmeter 24.1; filling material tank 25; gas chamber 25.1; liquid chamber 25.2; neck sealing device 26; gas channel 27; vacuum source 28; feed line 29.1; feed line 29.2; carbon dioxide source 30; sealing element 33; steam source 34; dispensing opening 37; drive 40; closing force Fy; retaining force Fy'; pressure sensor DS; temperature sensor TS; mid-axis MA; filling and closing apparatus PV; regulating circuit RK; vertical axis VA; handling station S, ST; and first to fifth control valves SV1 . . . SV5.

At least one possible exemplary embodiment of the present application relates to a method of filling and closing of containers 2 at a filling and closing apparatus 4 of a handling station S, with which a sealable process chamber 17 is provided at the filling and closing apparatus 4, with at least one pressure sensor DS for detecting the actual pressure values prevailing in the process chamber 17, wherein, before the initiation of a filling phase, at least the interior of the container 2, arranged in a sealing position at the filling and closing apparatus 4, in an evacuation phase, is first evacuated at least once to a negative pressure of preferably 0.05 to 0.15 residual pressure, and then, in a flushing phase, is flushed with steam and/or a flushing gas containing steam in such a way that, before the opening of the filling valve 4.1 for the filling of the container 2 with the liquid filling material, the flushing gas pressure in the container 2 is increased at least to atmospheric pressure, wherein, in the actual filling phase, the filling valve 4.1 is opened and the liquid filling material flows into the container 2, which is arranged in the sealing position at the filling and closing apparatus 4, wherein, after the ending of the filling phase, a settling phase is carried out at the filling and closing apparatus 4 of the handling station S, in which the processing chamber 17, such as above the mouth of the container 2, is adjusted by means of steam, and/or a gas containing steam, to a pressure which lies at a carbon dioxide saturation pressure of the filled filling material or above this, wherein, after the settling phase, the container 2, while still at the filling and closing apparatus 4 of the handling station S, is closed by the pressing of a closure cover 6, under the pressure conditions adjusted and set during the settling phase, before the interior pressure of the process chamber 17 is relaxed to atmospheric pressure, and wherein at least the evacuation phase and/or the flushing phase and/or the settling phase is controlled and/or regulated as a dependency of the actual pressure values detected by the pressure sensor DS.

At least one other possible exemplary embodiment of the present application relates to the method of filling and closing of containers, wherein, with the incorporation of the at least one pressure sensor DS, a regulating circuit RK is formed, by which at least the evacuation phase and/or the flushing phase and/or the settling phase are controlled and/or regulated as a dependency of the actual pressure values detected, wherein the filling valve 4.1 and/or at least one of the first to fifth control valves SV1 . . . SV5 are provided as actuators in the regulating circuit RK.

At least one other possible exemplary embodiment of the present application relates to the method of filling and closing of containers, wherein the evacuation phase and/or the flushing phase and/or the settlement phase are controlled and/or regulated by means of preselectable pressure characteristics with the incorporation of the regulating circuit RK.

At least one other possible exemplary embodiment of the present application relates to the method of filling and closing of containers, wherein, in the regulating circuit RK, the actual pressure values detected by the pressure sensor DS are transferred to a machine control device, and are compared with reference pressure values stored there, and, based on this, the filling valve 4.1 and/or at least one of the first to the fifth control valves SV1 . . . SV5 are initiated as actuators.

At least one other possible exemplary embodiment of the present application relates to the method of filling and closing of containers, wherein, for the respective beginning and the end of the evacuation phase and/or the flushing phase and/or the settling phase, reference pressure values are determined, which are then compared with the respective actual pressure values from the evacuation phase currently being carried out, and, on reaching the reference pressure values, an immediate switch takes place from the corresponding evacuation phase and/or flushing phase and/or settlement phase currently being carried out to the following downstream phases.

At least one other possible exemplary embodiment of the present application relates to the method of filling and closing of containers, wherein the evacuation phase and/or the flushing phase are in each case carried out several times, and specifically by alternating to and fro switching between the evacuation phase and the flushing phase.

At least one other possible exemplary embodiment of the present application relates to the method of filling and closing of containers, wherein, as a dependency of the pressure, immediately after reaching a predetermined reference pressure value, a switch takes place from the phase currently being carried out to the phase following this in the filling and closing process, and specifically as a dependency of the actual pressure values detected by the pressure sensor DS.

At least one other possible exemplary embodiment of the present application relates to the method of filling and closing of containers, wherein the components which are subjected to steam in the filling and closing apparatus 4 are manufactured from a material with low thermal conductivity and/or thermal capacity.

At least one other possible exemplary embodiment of the present application relates to the method of filling and closing of containers, wherein the container 2, in its sealed filling and closing position PV is pressed by a carrier element 3 into a sealing position against a sealing element 33, which concentrically surrounds a dispensing opening 37 for the liquid filling material, wherein the sealing element 33 is arranged at a pusher element 21 so as to be movable transversely to the vertical axis VA inside the process chamber 17.

At least one other possible exemplary embodiment of the present application relates to the method of filling and closing of containers, wherein a liquid channel 23 is formed in the pusher element 21, which, with the intermediate engagement of the filling valve 4.1, can be connected via a filling material line 24 to a filling material tank 25.

At least one other possible exemplary embodiment of the present application relates to the method of filling and closing of containers, wherein a gas channel 27 is formed in the pusher element 21, which can be fluidically connected via a first control valve SV1 as well as via a first feed line 29.1, and with the intermediate engagement of a third control valve SV3, to a carbon dioxide source 30, via a fourth control valve SV4 to a steam source 34, and via a fifth control valve SV5 to a vacuum source 28.

At least one other possible exemplary embodiment of the present application relates to the method of filling and closing of containers, wherein, in the process chamber 17 at least one temperature sensor TS is provided for detecting the actual temperature values prevailing in the processing chamber 17, which are taken into account as regulating values in the regulating circuit RK.

At least one possible exemplary embodiment of the present application relates to a method of filling and closing containers, such as bottles, cans, or similar containers, configured to contain a liquid material, such as a liquid beverage or similar, in a filling and closing arrangement at a handling station of a filling and closing machine, said method comprising: moving a container comprising a bottle, can, or similar container to said handling station of said filling and closing machine; moving said container into sealing engagement with said filling and closing arrangement at said handling station, and thereby sealing a process chamber of said filling and closing arrangement from the surrounding environment; performing an evacuation step comprising evacuating the interior of said container at least once and producing a container pressure inside said container below atmospheric pressure; performing a flushing step comprising flushing the interior of said container with steam or a flushing gas comprising steam, and thereby increasing said container pressure to at least atmospheric pressure; performing a filling step comprising opening a filling valve of said filling and closing arrangement and flowing liquid filling material into said container; performing a settling step comprising adjusting a chamber pressure in said processing chamber, using steam or a settling gas comprising steam, to a first chamber pressure at or above a carbon dioxide saturation pressure of said liquid filling material; performing a closing step, at essentially said first chamber pressure, comprising pressing a closure cover onto an opening in said container using a closing device of said filling and closing arrangement of said handling station; and detecting, using at least one pressure sensor disposed in said process chamber, at least one actual pressure in said process chamber, and controlling the performance of at least one of said evacuation step, said flushing step, and said settling step based on said at least one actual pressure detected by said at least one pressure sensor.

At least one other possible exemplary embodiment of the present application relates to the method of filling and closing containers, such as bottles, cans, or similar containers, wherein said step of producing a container pressure inside said container below atmospheric pressure comprises producing a container pressure in the range of approximately 0.05 bar to 0.15 bar.

At least one other possible exemplary embodiment of the present application relates to the method of filling and closing containers, such as bottles, cans, or similar containers, wherein: said filling and closing arrangement comprises control valves configured to control flow of gases, steam, and/or gas comprising steam; said at least one pressure sensor is operatively connected to said filling valve and said control valves to form a control circuit; and said step of controlling the performance of at least one of said evacuation step, said flushing step, and said settling step comprises actuating or operating at least one of said filling valve and said control valves of said control circuit.

At least one other possible exemplary embodiment of the present application relates to the method of filling and closing containers, such as bottles, cans, or similar containers, wherein said step of controlling the performance of at least one of said evacuation step, said flushing step, and said settling step comprises controlling the performance using preselectable pressure characteristics in conjunction with said regulating circuit.

At least one other possible exemplary embodiment of the present application relates to the method of filling and closing containers, such as bottles, cans, or similar containers, wherein said method further comprises: providing said at least one actual pressure value detected by said at least one pressure sensor to a machine control device; comparing said at least one actual pressure value with at least one reference pressure value stored in said machine control device; and actuating or operating at least one of said filling valve and said control valves based on the comparison.

At least one other possible exemplary embodiment of the present application relates to the method of filling and closing containers, such as bottles, cans, or similar containers, wherein said method further comprises: determining reference pressure values that correspond to a pressure value for the start and end of each of said evacuation step, said flushing step, and said settling step; continuously or periodically detecting actual pressure values in said process chamber and comparing said actual pressure values to said start and end reference pressure values; and upon determining said actual pressure value detected in said process chamber being equivalent or essentially equivalent to one of said start and end reference pressure values, immediately or essentially immediately switching from the corresponding one of said evacuation step, said flushing step, and said settling step to a subsequent step.

At least one other possible exemplary embodiment of the present application relates to the method of filling and closing containers, such as bottles, cans, or similar containers, wherein said method further comprises performing at least one of said evacuation step and said flushing step multiple times by switching back and forth between said evacuation step and said flushing step in an alternating manner.

At least one other possible exemplary embodiment of the present application relates to the method of filling and closing containers, such as bottles, cans, or similar containers, wherein, upon reaching a predetermined reference pressure value for a step in the filling and closing process, immediately switching from a step currently being carried out to a following step, which switching being dependent on said actual pressure values detected by said pressure sensor.

At least one other possible exemplary embodiment of the present application relates to the method of filling and closing containers, such as bottles, cans, or similar containers, wherein said filling and closing arrangement comprising components configured and disposed to be exposed to steam and/or high temperature gas, which components comprise a material with low thermal conductivity and/or thermal capacity.

At least one other possible exemplary embodiment of the present application relates to the method of filling and closing containers, such as bottles, cans, or similar containers, wherein: said step of moving said container into sealing engagement comprises pressing, with a carrier element, a lip or edge of a mouth opening in said container against a sealing element configured and disposed to concentrically surround a dispensing opening configured to permit dispensing of liquid filling material into said container; said filling and closing arrangement comprises a pusher element configured and disposed to be moved back and forth inside said process chamber transverse to a vertical axis of said filling and closing arrangement; and said sealing element is disposed at or on said pusher element and is movable with said pusher element.

At least one other possible exemplary embodiment of the present application relates to the method of filling and closing containers, such as bottles, cans, or similar containers, wherein said pusher element comprises a liquid channel configured and disposed to be moved into and out of connection with said filling valve, and thereby into and out of connection with a filling material line connected to a filling material tank, and said method further comprises moving said liquid channel into and out of connection with said filling valve.

At least one other possible exemplary embodiment of the present application relates to the method of filling and closing containers, such as bottles, cans, or similar containers, wherein: said control valves are openable and closable to control flow of media therethrough; said control valves comprise a first control valve, a second control valve, a third control valve, a fourth control valve, and a fifth control valve; said pusher element comprises a gas channel configured to be operatively connected via said first control valve and a first feed line; said gas channel is configured to be connected via said third control valve to a carbon dioxide source; said gas channel is configured to be connected via said fourth control valve to a steam source; and said gas channel is configured to be connected via a fifth control valve to a vacuum source.

At least one other possible exemplary embodiment of the present application relates to the method of filling and closing containers, such as bottles, cans, or similar containers, wherein: said filling and closing arrangement comprises at least one temperature sensor disposed in said process chamber; and said at least one temperature sensor is configured and disposed to detect actual temperature values in said processing chamber, which actual temperature values are taken into account as regulating values in said regulating circuit.

At least one other possible exemplary embodiment of the present application relates to the method of filling and closing containers, such as bottles, cans, or similar containers, wherein said method further comprises: determining reference pressures minimally sufficient to perform at least each of said evacuation step, said flushing step, and said settling step; storing said reference pressures in a machine control device configured to control operation of said filling and closing arrangement; continuously or periodically detecting, using said at least one pressure sensor, actual pressures in said process chamber at least during performance of said evacuation step, said flushing step, and said settling step, which actual pressures are of differing values; providing said detected actual pressures to said machine control device; comparing said detected actual pressures with said reference pressures; and upon said detected actual pressure being at a reference pressure corresponding to one of said evacuation step, said flushing step, and said settling step, essentially immediately initiating or switching to performance of said corresponding one of said evacuation step, said flushing step, and said settling step.

At least one other possible exemplary embodiment of the present application relates to the method of filling and closing containers, such as bottles, cans, or similar containers, wherein: said filling and closing arrangement comprises control valves configured to control flow of gases, steam, and/or gas comprising steam to thereby control and adjust performance of said evacuation step, said flushing step, and said settling step; and said method further comprises controlling performance of said evacuation step, said flushing step, and said settling step by actuating or operating at least one of said filling valve and said control valves.

At least one other possible exemplary embodiment of the present application relates to the method of filling and closing containers, such as bottles, cans, or similar containers, wherein said method further comprises performing at least one of said evacuation step and said flushing step multiple times by switching back and forth between said evacuation step and said flushing step in an alternating manner, wherein said switching is performed upon detecting an actual pressure in said pressure chamber equivalent or essentially equivalent to a reference pressure sufficient to switch from said evacuation step to said flushing step and vice versa.

At least one other possible exemplary embodiment of the present application relates to the method of filling and closing containers, such as bottles, cans, or similar containers, wherein: said step of moving said container into sealing engagement comprises pressing, with a carrier element, a lip or edge of a mouth opening in said container against a sealing element configured and disposed to concentrically surround a dispensing opening configured to permit dispensing of liquid filling material into said container; said filling and closing arrangement comprises a pusher element configured and disposed to be moved back and forth inside said process chamber in a direction transverse to a longitudinal axis of said container; and said sealing element is disposed at or on said pusher element and is movable with said pusher element.

At least one other possible exemplary embodiment of the present application relates to the method of filling and closing containers, such as bottles, cans, or similar containers, wherein said pusher element comprises a liquid channel configured and disposed to be moved into and out of connection with said filling valve, and thereby into and out of connection with a filling material line connected to a filling material tank, and said method further comprises moving said liquid channel into and out of connection with said filling valve.

At least one other possible exemplary embodiment of the present application relates to the method of filling and closing containers, such as bottles, cans, or similar containers, wherein said filling and closing arrangement comprises a closing device to press a crown cork or crown cap onto the mouth of a filled container disposed in said process chamber, and said method further comprises: upon said container being filled with said liquid filling material, moving said pusher element laterally out from a position between said closing device and said container; and actuating said closing device and pressing a crown cork or crown cap onto the mouth of said filled container disposed in said process chamber.

At least one other possible exemplary embodiment of the present application relates to the method of filling and closing containers, such as bottles, cans, or similar containers, wherein: said filling and closing arrangement comprises at least one temperature sensor disposed in said process chamber; said at least one temperature sensor is configured and disposed to detect actual temperature values in said processing chamber; and said method further comprises providing said actual temperature values to said machine control device and controlling performance of at least said evacuation step, said flushing step, and said settling step based on said actual temperature values.

Any numerical values disclosed herein, if any, should be understood as disclosing all approximate values within plus or minus ten percent of the numerical value. Any ranges of numerical values disclosed herein, if any, should be understood as disclosing all individual values within the range of values, including whole numbers, tenths of numbers, or hundredths of numbers.

The entirety of the appended drawings, including all dimensions, proportions, and/or shapes disclosed thereby or reasonably understood therefrom, are hereby incorporated by reference.

All of the patents, patent applications, patent publications, and other documents cited herein, are hereby incorporated by reference as if set forth in their entirety herein.

The corresponding foreign or international patent applications, as originally filed and as published, from which the present application claims the benefit of priority, are hereby incorporated by reference as if set forth in their entirety herein, as follows: PCT/EP2020/073690; WO2021043621; and DE102019123460.3.

The following patents, patent applications, patent publications, and other documents cited in the corresponding foreign or international patent applications listed in the preceding paragraph are hereby incorporated by reference as if set forth in their entirety herein, as follows: DE102014104873A1; EP2927189A1; EP1127835A1; EP3473588A1; DE10008426B4; and DE102016108502A1.

Although the invention has been described in detail for the purpose of illustration of any embodiments disclosed herein, including the most practical or preferred embodiments at the time of filing of this application, it is to be understood that such detail is solely for that purpose and that the invention is not limited to such embodiments, but, on the contrary, is intended to cover modifications and equivalent arrangements that are within the spirit and scope of the present application, including the specification and the claims as originally filed, as amended, or as issued. For example, it is to be understood that the present invention contemplates that, to the extent possible, one or more features or components of any disclosed embodiment can be combined with one or more features or components of any other disclosed embodiment.

What is claimed is:

1. A method of filling and closing containers configured to contain a liquid material in a filling and closing arrangement at a handling station of a filling and closing machine, said method comprising:

moving a container comprising a bottle, can, or similar container to said handling station of said filling and closing machine;

moving said container into sealing engagement with said filling and closing arrangement at said handling station, and thereby sealing a process chamber of said filling and closing arrangement from the surrounding environment;

performing an evacuation step comprising evacuating the interior of said container at least once and producing a container pressure inside said container below atmospheric pressure;

performing a flushing step comprising flushing the interior of said container with steam or a flushing gas comprising steam, and thereby increasing said container pressure to at least atmospheric pressure;

performing a filling step comprising opening a filling valve of said filling and closing arrangement and flowing liquid filling material into said container;

performing a settling step comprising adjusting a chamber pressure in said processing chamber, using steam or a settling gas comprising steam, to a first chamber pressure at or above a carbon dioxide saturation pressure of said liquid filling material;

performing a closing step, at essentially said first chamber pressure, comprising pressing a closure cover onto an opening in said container using a closing device of said filling and closing arrangement of said handling station; and detecting, using at least one pressure sensor disposed in said process chamber, at least one actual pressure in said process chamber, and controlling the performance of at least one of said evacuation step, said flushing step, and said settling step based on said at least one actual pressure detected by said at least one pressure sensor.

2. The method of filling and closing containers according to claim 1, wherein said step of producing a container pressure inside said container below atmospheric pressure comprises producing a container pressure in the range of approximately 0.05 bar to 0.15 bar.

3. The method of filling and closing containers according to claim 2, wherein:

said filling and closing arrangement comprises control valves configured to control flow of gases, steam, and/or gas comprising steam;

said at least one pressure sensor is operatively connected to said filling valve and said control valves to form a control circuit; and said step of controlling the performance of at least one of said evacuation step, said flushing step, and said settling step comprises actuating or operating at least one of said filling valve and said control valves of said control circuit.

4. The method of filling and closing containers according to claim 3, wherein said step of controlling the performance of at least one of said evacuation step, said flushing step, and said settling step comprises controlling the performance using preselectable pressure characteristics in conjunction with said regulating circuit.

5. The method of filling and closing containers according to claim 4, wherein said method further comprises:

providing said at least one actual pressure value detected by said at least one pressure sensor to a machine control device;

comparing said at least one actual pressure value with at least one reference pressure value stored in said machine control device; and actuating or operating at least one of said filling valve and said control valves based on the comparison.

6. The method of filling and closing containers according to claim 5, wherein said method further comprises:

determining reference pressure values that correspond to a pressure value for the start and end of each of said evacuation step, said flushing step, and said settling step;

continuously or periodically detecting actual pressure values in said process chamber and comparing said actual pressure values to said start and end reference pressure values; and upon determining said actual pressure value detected in said process chamber being equivalent or essentially equivalent to one of said start and end reference pressure values, immediately or essentially immediately switching from the corresponding one of said evacuation step, said flushing step, and said settling step to a subsequent step.

7. The method of filling and closing containers according to claim 6, wherein said method further comprises performing at least one of said evacuation step and said flushing step multiple times by switching back and forth between said evacuation step and said flushing step in an alternating manner.

8. The method of filling and closing containers according to claim 7, wherein, upon reaching a predetermined reference pressure value for a step in the filling and closing process, immediately switching from a step currently being carried out to a following step, which switching being dependent on said actual pressure values detected by said pressure sensor.

9. The method of filling and closing containers according to claim 8, wherein said filling and closing arrangement comprising components configured and disposed to be exposed to steam and/or high temperature gas, which components comprise a material with low thermal conductivity and/or thermal capacity.

10. The method of filling and closing containers according to claim 9, wherein:

said step of moving said container into sealing engagement comprises pressing, with a carrier element, a lip or edge of a mouth opening in said container against a sealing element configured and disposed to concentrically surround a dispensing opening configured to permit dispensing of liquid filling material into said container;

said filling and closing arrangement comprises a pusher element configured and disposed to be moved back and forth inside said process chamber transverse to a vertical axis of said filling and closing arrangement; and said sealing element is disposed at or on said pusher element and is movable with said pusher element.

11. The method of filling and closing containers according to claim 10, wherein said pusher element comprises a liquid channel configured and disposed to be moved into and out of connection with said filling valve, and thereby into and out of connection with a filling material line connected to a filling material tank, and said method further comprises moving said liquid channel into and out of connection with said filling valve.

12. The method of filling and closing containers according to claim 11, wherein:

said control valves are openable and closable to control flow of media therethrough; said control valves comprise a first control valve, a second control valve, a third control valve, a fourth control valve, and a fifth control valve;

said pusher element comprises a gas channel configured to be operatively connected via said first control valve and a first feed line;

said gas channel is configured to be connected via said third control valve to a carbon dioxide source;

said gas channel is configured to be connected via said fourth control valve to a steam source; and said gas channel is configured to be connected via a fifth control valve to a vacuum source.

13. The method of filling and closing containers according to claim 12, wherein:

said filling and closing arrangement comprises at least one temperature sensor disposed in said process chamber; and said at least one temperature sensor is configured and disposed to detect actual temperature values in said processing chamber, which actual temperature values are taken into account as regulating values in said regulating circuit.

14. The method of filling and closing containers according to claim 1, wherein said method further comprises:

determining reference pressures minimally sufficient to perform at least each of said evacuation step, said flushing step, and said settling step;

storing said reference pressures in a machine control device configured to control operation of said filling and closing arrangement;

continuously or periodically detecting, using said at least one pressure sensor, actual pressures in said process chamber at least during performance of said evacuation step, said flushing step, and said settling step, which actual pressures are of differing values;

providing said detected actual pressures to said machine control device;

comparing said detected actual pressures with said reference pressures; and upon said detected actual pressure being at a reference pressure corresponding to one of said evacuation step, said flushing step, and said settling step, essentially immediately initiating or switching to performance of said corresponding one of said evacuation step, said flushing step, and said settling step.

15. The method of filling and closing containers according to claim 14, wherein:

said filling and closing arrangement comprises control valves configured to control flow of gases, steam, and/or gas comprising steam to thereby control and adjust performance of said evacuation step, said flushing step, and said settling step; and said method further comprises controlling performance of said evacuation step, said flushing step, and said settling step by actuating or operating at least one of said filling valve and said control valves.

16. The method of filling and closing containers according to claim 15, wherein said method further comprises performing at least one of said evacuation step and said flushing step multiple times by switching back and forth between said evacuation step and said flushing step in an alternating manner, wherein said switching is performed upon detecting an actual pressure in said pressure chamber equivalent or essentially equivalent to a reference pressure sufficient to switch from said evacuation step to said flushing step and vice versa.

17. The method of filling and closing containers according to claim 16, wherein:

said step of moving said container into sealing engagement comprises pressing, with a carrier element, a lip or edge of a mouth opening in said container against a sealing element configured and disposed to concentrically surround a dispensing opening configured to permit dispensing of liquid filling material into said container;

said filling and closing arrangement comprises a pusher element configured and disposed to be moved back and forth inside said process chamber in a direction transverse to a longitudinal axis of said container; and said sealing element is disposed at or on said pusher element and is movable with said pusher element.

18. The method of filling and closing containers according to claim 17, wherein said pusher element comprises a liquid channel configured and disposed to be moved into and out of connection with said filling valve, and thereby into and out of connection with a filling material line connected to a filling material tank, and said method further comprises moving said liquid channel into and out of connection with said filling valve.

19. The method of filling and closing containers according to claim 18, wherein said filling and closing arrangement comprises a closing device to press a crown cork or crown cap onto the mouth of a filled container disposed in said process chamber, and said method further comprises:

upon said container being filled with said liquid filling material, moving said pusher element laterally out from a position between said closing device and said container; and actuating said closing device and pressing a crown cork or crown cap onto the mouth of said filled container disposed in said process chamber.

20. The method of filling and closing containers according to claim 19, wherein:

said filling and closing arrangement comprises at least one temperature sensor disposed in said process chamber;

said at least one temperature sensor is configured and disposed to detect actual temperature values in said processing chamber; and said method further comprises providing said actual temperature values to said machine control device and controlling performance of at least said evacuation step, said flushing step, and said settling step based on said actual temperature values.

* * * * *